US011143976B2

(12) United States Patent
Kitagawa et al.

(10) Patent No.: US 11,143,976 B2
(45) Date of Patent: Oct. 12, 2021

(54) PHOTOCONDUCTOR HAVING INTERLAYER FOR HOLE INJECTION PROMOTION

(71) Applicant: FUJI ELECTRIC CO., LTD., Kawasaki (JP)

(72) Inventors: Seizo Kitagawa, Matsumoto (JP); Kazuya Saito, GuangDong (CN); Kazuki Nebashi, Matsumoto (JP); Hiroshi Emori, GuangDong (CN); Masaru Takeuchi, Matsumoto (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 0 days.

(21) Appl. No.: 16/733,701

(22) Filed: Jan. 3, 2020

(65) Prior Publication Data

US 2020/0142328 A1 May 7, 2020

Related U.S. Application Data

(63) Continuation of application No. PCT/JP2018/048603, filed on Dec. 28, 2018.

(51) Int. Cl.
*G03G 5/14* (2006.01)
*G03G 5/047* (2006.01)
(Continued)

(52) U.S. Cl.
CPC ..... *G03G 5/142* (2013.01); *G03G 5/047* (2013.01); *G03G 5/0696* (2013.01); *G03G 15/75* (2013.01)

(58) Field of Classification Search
CPC ..... G03G 5/142; G03G 5/0525
See application file for complete search history.

(56) References Cited

U.S. PATENT DOCUMENTS 4,792,507 A 12/1988 Yoshihara et al.
4,882,253 A * 11/1989 Kato ..... G03G 5/047 430/58.45

(Continued)

FOREIGN PATENT DOCUMENTS

JP H03-256050 A 11/1991
JP H04-241359 A 8/1992

(Continued)

*Primary Examiner* — Christopher D Rodee
(74) *Attorney, Agent, or Firm* — Rabin & Berdo, P.C.

(57) ABSTRACT

A photoconductor for electrophotography includes a base member; an anodic oxide coating provided on the base member and having a film thickness of 2 to 10 μm; an interlayer provided on the anodic oxide coating and containing a vinyl chloride-vinyl acetate copolymer resin and having a film thickness of 0.02 to 0.3 μm; and a photosensitive layer including a charge transport layer formed on the interlayer and containing a charge transport material and a first resin binder, and a charge generation layer laminated on the charge transport layer and containing a charge generation material, a hole transport material, a first electron transport material that is a naphthalenetetracarboxylic diimide compound, a second electron transport material that is an azoquinone compound, a diphenoquinone compound, or a stilbenequinone compound and that has a mobility of $17\times10^{-8}$ $cm^2/V\cdot s$ or more, and a second resin binder.

10 Claims, 5 Drawing Sheets

(51) Int. Cl.
*G03G 5/06* (2006.01)
*G03G 15/00* (2006.01)

(56) References Cited

U.S. PATENT DOCUMENTS

| | | | | |
|---|---|---|---|---|
| 5,324,606 | A * | 6/1994 | Hodumi | G03G 5/047 430/58.8 |
| 5,324,610 | A | 6/1994 | Tanaka et al. | |
| 6,127,076 | A | 10/2000 | Ishigami et al. | |
| 6,174,638 | B1 | 1/2001 | Ishigami et al. | |
| 6,432,595 | B1 | 8/2002 | Kawaguchi et al. | |
| 6,656,650 | B1 | 12/2003 | Lin et al. | |
| 2003/0211413 | A1 | 11/2003 | Lin et al. | |
| 2004/0096761 | A1 | 5/2004 | Lin et al. | |
| 2004/0197685 | A1 | 10/2004 | Ioannidis et al. | |
| 2005/0186494 | A1 | 8/2005 | Inagaki et al. | |
| 2006/0110671 | A1 | 5/2006 | Lin et al. | |
| 2006/0292465 | A1* | 12/2006 | Yamada | G03G 5/142 430/56 |
| 2006/0292468 | A1 | 12/2006 | Yokota et al. | |
| 2007/0049676 | A1* | 3/2007 | Wu | G03G 5/142 524/430 |
| 2007/0092296 | A1 | 4/2007 | Ishino | |
| 2007/0202422 | A1* | 8/2007 | Levy | G03G 5/142 430/60 |
| 2009/0068577 | A1 | 3/2009 | Ohta et al. | |
| 2011/0091799 | A1 | 4/2011 | Nakamura et al. | |
| 2012/0003574 | A1 | 1/2012 | Kitagawa et al. | |
| 2012/0058422 | A1 | 3/2012 | Suzuki et al. | |
| 2014/0087298 | A1 | 3/2014 | Wu et al. | |
| 2014/0199619 | A1* | 7/2014 | Kitagawa | G03G 5/047 430/56 |
| 2018/0224760 | A1 | 8/2018 | Suzuki et al. | |
| 2018/0307147 | A1* | 10/2018 | Suzuki | G03G 5/061473 |

FOREIGN PATENT DOCUMENTS

| | | | |
|---|---|---|---|
| JP | H04-242259 | A | 8/1992 |
| JP | H05-12702 | B2 | 2/1993 |
| JP | H05-45915 | A | 2/1993 |
| JP | H05-30262 | B2 | 5/1993 |
| JP | H05-47822 | B2 | 7/1993 |
| JP | H07-160017 | A | 6/1995 |
| JP | H07-181703 | A | 7/1995 |
| JP | 2000-019746 | A | 1/2000 |
| JP | 2000-019748 | A | 1/2000 |
| JP | 2000-019756 | A | 1/2000 |
| JP | 2000-231213 | A | 8/2000 |
| JP | 3292461 | B2 | 6/2002 |
| JP | 3373783 | B2 | 2/2003 |
| JP | 2004-038167 | A | 2/2004 |
| JP | 3532808 | B2 | 5/2004 |
| JP | 2004-170984 | A | 6/2004 |
| JP | 3556146 | B2 | 8/2004 |
| JP | 2004-269441 | A | 9/2004 |
| JP | 2004-310089 | A | 11/2004 |
| JP | 2005-208617 | A | 8/2005 |
| JP | 2005-208618 | A | 8/2005 |
| JP | 2005-275373 | A | 10/2005 |
| JP | 2006-146227 | A | 6/2006 |
| JP | 2007-011356 | A | 1/2007 |
| JP | 2007-322576 | A | 12/2007 |
| JP | 2009-222894 | A | 10/2009 |
| JP | 2009-288569 | A | 12/2009 |
| JP | 2009-292802 | A | 12/2009 |
| JP | 2010-181585 | A | 8/2010 |
| JP | 2012-137667 | A | 7/2012 |
| JP | 2014-146001 | A | 8/2014 |
| JP | 2015-094839 | A | 5/2015 |
| JP | 2018-004695 | A | 1/2018 |
| JP | 2018-017765 | A | 2/2018 |
| WO | 2009/104571 | A1 | 8/2009 |
| WO | 2010/092695 | A1 | 8/2010 |
| WO | 2016/159244 | A1 | 10/2016 |
| WO | 2017/110300 | A1 | 6/2017 |

* cited by examiner

PHOTOCONDUCTOR HAVING INTERLAYER FOR HOLE INJECTION PROMOTION

CROSS-REFERENCE TO RELATED APPLICATION

This application is a continuation application of International Application PCT/JP2018/048603, filed on Dec. 28, 2018, which designated the U.S., the entire contents of which are incorporated herein by reference.

BACKGROUND OF THE INVENTION

Field of the Invention

The present invention relates to a photoconductor for electrophotography (hereinafter also referred to simply as a "photoconductor") used in electrophotographic printers, copiers, fax machines, and the like, a method of producing the photoconductor, and an electrophotographic device.

Related Art

A photoconductor for electrophotography has a basic structure in which a photosensitive layer having a photoconductive function is disposed on an electroconductive base member. In recent years, photoconductors that are produced using an organic compound and used for organic electrophotography as functional components serving for generation and transport of electric charges have vigorously been researched and developed and have increasingly been used for copiers, printers, and the like because such photoconductor materials have advantages such as diversity, high productivity, and safety.

In general, photoconductors need to have a function for retaining surface charges in a dark place, a function for receiving light to generate charges, and further a function for transporting generated charges. Examples of such photoconductors include: what is called a monolayer photoconductor including a photosensitive monolayer having these functions together; and what is called a layered (separated-function) photoconductor including a photosensitive layer composed of laminated layers having separate functions: one layer is a charge generation layer mainly having a function for generating charges by light reception; and the other layer is a charge transport layer having a function for retaining surface charges in a dark place and a function for transporting charges generated in the charge generation layer by light reception.

Among these, positively charged organic photoconductors the surface of which has charge characteristics as positive charge are classified roughly into four types by layer constitution, as below-mentioned, and various such photoconductors have been devised hitherto. The first type is a two-layered separated-function photoconductor in which a charge transport layer and a charge generation layer are laminated in this order on an electroconductive base member (see, for example, Patent Document 1 and Patent Document 2). The second type is a three-layered separated-function photoconductor in which a surface protection layer is laminated on the above-mentioned two-layer structure (see, for example, Patent Document 3, Patent Document 4, and Patent Document 5). The third type is a two-layered separated-function photoconductor in which a charge generation layer and a charge (electron) transport layer are laminated in this order, in the order converse to that in the first one, on an electroconductive base member (see, for example, Patent Document 6 and Patent Document 7). The fourth type is a monolayer photoconductor in which a charge generation material, a hole transport material, and an electron transport material are dispersed in the same layer (see, for example, Patent Document 6 and Patent Document 8). It should be noted that the above-mentioned classification into four types does not consider whether the photoconductor includes an under coat layer.

Among these, the last fourth monolayer photoconductor has been studied in detail and been increasingly put into practical use generally and widely. The main reason for this is considered to be that this monolayer photoconductor is constituted such that the hole transport material complements the electron transport function of the electron transport material, wherein the electron transport function is inferior in transport capability to the hole transport function of the hole transport material. This monolayer photoconductor is a dispersion type, and thus, carriers are generated also in the inside of the film. It is conceivable that, because the amount of generation of carriers is larger nearer to the vicinity of the surface of the photosensitive layer, and because the electron transport distance can be smaller than the hole transport distance, the electron transport capability does not need to be as high as the hole transport capability. This materializes practically sufficient environmental stability and fatigue characteristics, compared with the other three types.

A monolayer photoconductor is composed of a single film having both functions for carrier generation and carrier transport, and thus has an advantage that the coating step can be simplified and that a high yield and high process capability can be obtained more easily, but contrarily, there is a problem in that causing a large amount of both hole transport material and electron transport material to be contained in a single layer in an attempt at higher sensitivity and higher speed decreases the binding resin content and accordingly decreases the durability. Accordingly, a monolayer photoconductor has its limitations in an attempt to achieve both higher sensitivity/higher speed and higher durability.

Because of this, it is difficult for a conventional monolayer positively charged organic photoconductor to manage to achieve all of the sensitivity, durability, and contamination resistance that allow devices in recent years to have a smaller size, higher speed, and higher definition, and to be color, and accordingly, a layered positively charged photoconductor has newly been devised, wherein a charge transport layer and a charge generation layer are sequentially laminated (see, for example, Patent Document 9 and Patent Document 10). The layer constitution of this layered positively charged photoconductor is similar to that of the above-mentioned first one, but allows the charge generation layer to contain a smaller amount of charge generation material and also contain an electron transport material, enables the charge generation layer to have a film thickness closer to the film thickness of the charge transport layer that is the lower layer, and besides, enables the addition amount of the hole transport material in the charge generation layer to be less, and thus, enables the ratio of resin in the charge generation layer to be set higher than the layer constitution of a conventional monolayer type, making it easier to achieve both higher sensitivity and higher durability.

In the recent market, an increase in the amount of information processing (an increase in printing volume), development of color printers, and an enhancement in the penetration rate of color printers are accompanied by progress in making printing speed higher, making devices smaller, and using fewer members, and in addition, meeting various usage environments is demanded. In such a situation, there is outstandingly an increasing demand for photoconductors causing a smaller variation in image characteristics and electric characteristics which is caused through repetitive usage and usage environments (room temperature and environment), and conventional technologies can no longer satisfy these demands at the same time. In particular, concerning the surface potential of a photoconductor, there is a strong demand that the following should be solved: ghost image generation due to the instability of a potential under a low temperature and low humidity environment or under a high temperature and high humidity environment; generation of color spots such as black spots which is due to charge leakage under a high temperature and high humidity environment; and solid density nonuniformity due to potential reversal caused by transfer.

RELATED ART DOCUMENTS

Patent Documents

Patent Document 1: JP05-30262B2
Patent Document 2: JP04-242259A
Patent Document 3: JP05-47822B2
Patent Document 4: JP05-12702B2
Patent Document 5: JP04-241359A
Patent Document 6: JP05-45915A
Patent Document 7: JP07-160017A
Patent Document 8: JP03-256050A
Patent Document 9: JP2009-288569A
Patent Document 10: WO2009/104571

BRIEF SUMMARY OF THE INVENTION

As above-mentioned, various studies based on various conventional requirements for photoconductors have been made on the layer constitution and functional materials of photoconductors. However, for black and white printers, whose printing speed is fast, and tandem color printers, it is difficult to solve, at the same time, worsening of ghost images which is due to repetitive usage under a low temperature and low humidity environment and under a high temperature and high humidity environment, and generation of color spots and locally and defectively transferred solid images under a high temperature and high humidity environment.

Of these problems, the latter one is considered to be due to a high transfer electric current value enough for securing transferability, in which the high current value is required by an increase in printing speed. If a large transfer electric current is supplied to a photoconductor in a transfer process and if the photoconductor has paper powder and a toner mixture adhered to the surface of the photoconductor, the photoconductor is more likely to suffer dielectric breakdown under a high temperature and high humidity environment. It is conceivable that the adhered matter supplies the inside of the photosensitive layer with water from the environment, causes some local portions of the layer to have lower resistance, and accordingly induces dielectric breakdown, resulting in generation of black spots and color spots. In addition, a large transfer electric current causes the potential of the photoconductor to be reversed, and the surface of the photoconductor is more likely to be reversely polarized (negatively polarized). It is conceivable that an oppositely charged photoconductor causes the positively charged toner once transferred on paper to be pulled back to the surface of the photoconductor again, and that a transfer defect (solid density nonuniformity, or a transfer-deficient image) having a width corresponding to approximately one round of the photoconductor is generated.

An object of the present invention is to solve the above-mentioned problems and provide a photoconductor for electrophotography, a method of producing the photoconductor, and an electrophotographic device, wherein the photoconductor is aimed at solving generation of ghost images under a low temperature and low humidity environment and under a high temperature and high humidity environment, obviating generation of black spots which is due to leakage under a high temperature and high humidity environment, and obviating solid density nonuniformity caused by potential reversal after transfer.

The present inventors have diligently studied and consequently discovered that a specific interlayer provided on an aluminum-made electroconductive base member with an anodic oxide coating in-between promotes hole injection from the base member into a photosensitive layer, and further that recoupling between positive and negative charges is promoted by using a combination of a specific hole transport material and a specific electron transport material. The present inventors have thus completed the invention.

In other words, a first aspect of the present invention is a photoconductor for electrophotography, including:

an aluminum-made electroconductive base member;

an anodic oxide coating provided on the electroconductive base member;

an interlayer provided on the anodic oxide coating; and a charge transport layer and a charge generation layer which are laminated on the interlayer in this order from the electroconductive base member side;

wherein the charge transport layer contains a charge transport material and a resin binder, wherein the charge generation layer contains a charge generation material, a hole transport material, and an electron transport material, and a resin binder, wherein the anodic oxide coating has a film thickness of 2 μm or more and 10 μm or less, and wherein the interlayer contains a vinyl chloride-vinyl acetate copolymer resin, the interlayer having a film thickness of 0.02 μm or more and 0.3 μm or less.

In this case, it is preferable that the charge transport layer and the charge generation layer each have a film thickness of 5 μm or more and 25 μm or less, and that the photosensitive layer has a total film thickness of 15 μm or more and 50 μm or less. In addition, the hole transport material preferably has an ionization potential Ip of 5.4 eV or less, and preferably has a mobility of $2\times10^{-5}$ $cm^2/V\cdot s$ or more. Further, the charge generation material is preferably titanylphthalocyanine.

Furthermore, it is preferable that the electron transport material contains a first electron transport material and a second electron transport material, that the first electron transport material is a naphthalenetetracarboxylic diimide compound, that the second electron transport material is an azoquinone compound, diphenoquinone compound, or stilbenequinone compound, and that the second electron transport material has a mobility of $17\times10^{-8}$ $cm^2/V\cdot s$ or more.

In addition, a method of producing a photoconductor for electrophotography according to a second aspect of the present invention includes, in producing the above-mentioned photoconductor for electrophotography, a step of forming the charge transport layer and the charge generation layer in order on the interlayer using a dip coating method.

Furthermore, an electrophotographic device according to a third aspect of the present invention is a tandem type of device for color printing, having the above-mentioned photoconductor for electrophotography mounted therein and having a printing speed of 24 ppm or more.

Furthermore, an electrophotographic device according to a fourth aspect of the present invention has the above-mentioned photoconductor for electrophotography mounted therein and has a printing speed of 40 ppm or more.

Here, a value can be used as an ionization potential Ip of the hole transport material, wherein the value is measured using, for example, a low energy electronic metering device that analyzes the surface of a sample by counting photoelectrons caused by ultraviolet excitation under a normal temperature and normal humidity environment.

According to the above-mentioned aspects of the present invention, it is possible to provide a photoconductor for electrophotography, a method of producing the photoconductor, and an electrophotographic device, wherein the photoconductor can solve the problems including: ghost images under a low temperature and low humidity environment and under a high temperature and high humidity environment; color spots, such as black spots, due to leakage under a high temperature and high humidity environment; and solid density nonuniformity caused by potential reversal after transfer.

DETAILED DESCRIPTION OF THE INVENTION

Below, specific embodiments of a photoconductor for electrophotography according to the present invention will be described in detail with reference to the drawings. The present invention is not limited to the following description at all.

Figure 1:
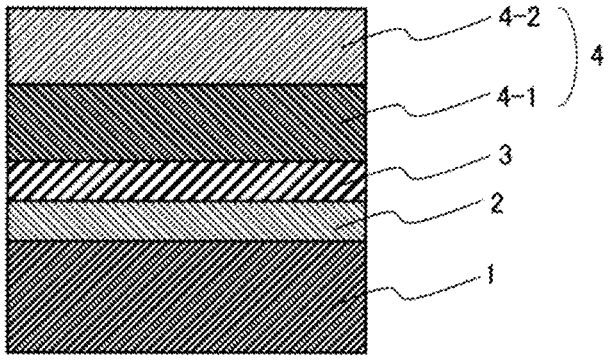
FIG. 1 is a schematic cross-sectional view depicting an example of a photoconductor for electrophotography according to the present invention.
Figure 2:
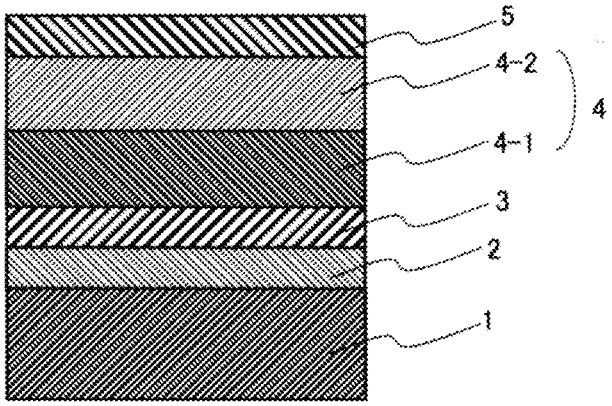
FIG. 2 is a schematic cross-sectional view depicting another example of a photoconductor for electrophotography according to the present invention.

FIGS. 1 and 2 are schematic cross-sectional views depicting an example of a photoconductor for electrophotography according to the present invention. The depicted photoconductors each show a layered positively charged photoconductor for electrophotography, which is constituted to contain an aluminum-made electroconductive base member 1 and a photosensitive layer 4 provided on the electroconductive base member 1, wherein the photosensitive layer 4 contains a charge transport layer 4-1 and a charge generation layer 4-2 that are laminated in this order from the electroconductive base member 1 side. The photoconductor in FIG. 2 is constituted to further have a surface protection layer 5 provided on the surface of the photoconductor in FIG. 1, but the surface protection layer 5 is not essential.

In the photoconductor according to an embodiment of the present invention, an interlayer 3 is provided on an anodic oxide coating 2 between the electroconductive base member 1 and the photosensitive layer 4, wherein the interlayer 3 contains a vinyl chloride-vinyl acetate copolymer resin and has a film thickness of 0.02 μm or more and 0.3 μm or less. In other words, the anodic oxide coating 2 is formed on the surface of the aluminum-made electroconductive base member 1, thereafter the predetermined interlayer 3 is further provided on the anodic oxide coating 2 on the surface of this electroconductive base member 1, and then the photosensitive layer 4 is laminated on the interlayer 3.

Providing the anodic oxide coating 2 on the surface of the electroconductive base member 1 makes it possible to prevent dielectric breakdown due to leakage under a high temperature and high humidity environment and suppress generation of black spots. In addition, it is considered effective to provide the interlayer 3 in order to promote hole injection from the electroconductive base member 1 to the photosensitive layer 4, in other words, to provide a step for movement of holes, wherein the interlayer 3 has an HOMO (Highest Occupied Molecular Orbital) level intermediate between the ionization potential of the photosensitive layer 4 and the work function of the surface of the anodic oxide coating 2 on the electroconductive base member 1.

Figure 6:
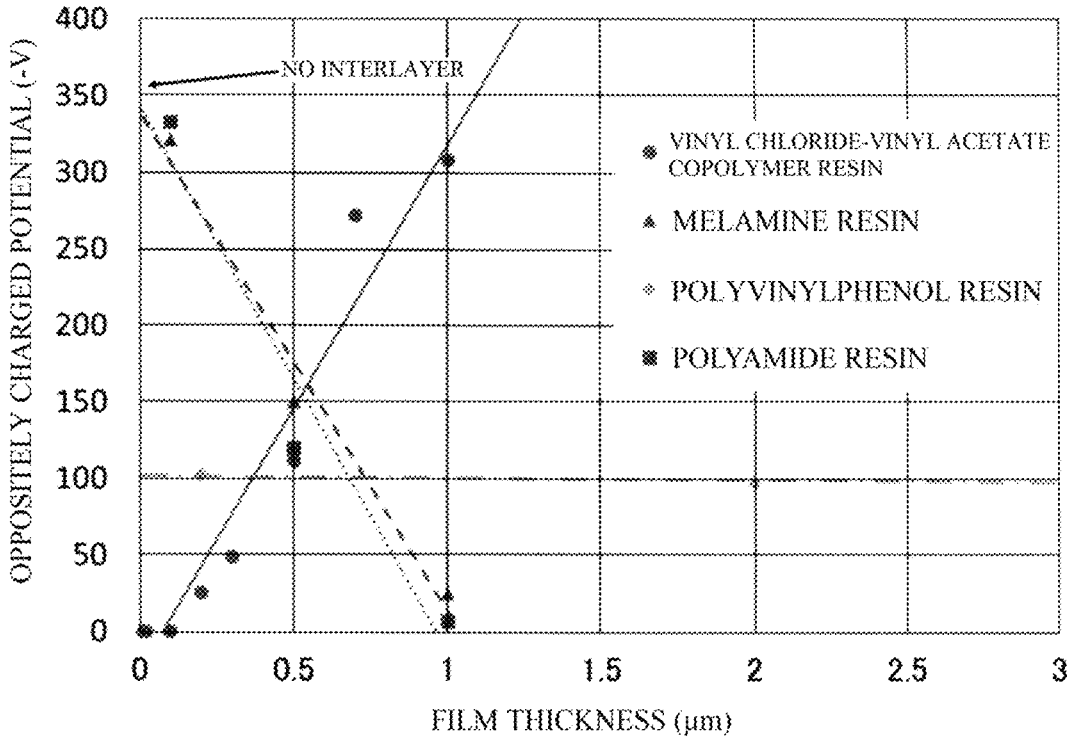
FIG. 6 is a graph depicting a value of reversal potential with respect to changes in the type and film thickness of a resin material used for an interlayer.

In this respect, the present inventors have further studied diligently and consequently discovered that the thin interlayer 3 promotes hole injection from the base member to the photosensitive layer and can suppress opposite charging by a transfer electrode (potential reversal), making it possible to solve the problem of solid density nonuniformity, wherein the interlayer 3 is inserted between the anodic oxide coating 2 and the photosensitive layer 4 and contains a vinyl chloride-vinyl acetate copolymer resin. FIG. 6 shows a graph depicting a value of oppositely charged potential (reversal potential) with respect to changes in the type and film thickness of a resin material used for an interlayer. FIG. 6 shows that the interlayer 3 which has a particularly small film thickness and is formed using a vinyl chloride-vinyl acetate copolymer resin as a resin material can suppress the oppositely charged potential extremely low, with respect to resins generally used for the interlayer 3, such as a polyamide resin, a melamine resin, and a polyvinylphenol resin. Even if a polyamide resin or a melamine resin is used, it is also possible to suppress oppositely charged potential if the film thickness is increased, but increasing the film thickness poses a problem of ghost image worsening. In contrast with this, the interlayer 3 containing a vinyl chloride-vinyl acetate copolymer resin makes it possible to obtain an effect of suppressing oppositely charged potential even if the film thickness is small, and thus, such an interlayer 3 does not worsen ghost images under a low temperature and low humidity environment and under a high temperature and high humidity environment.

Figure 7:
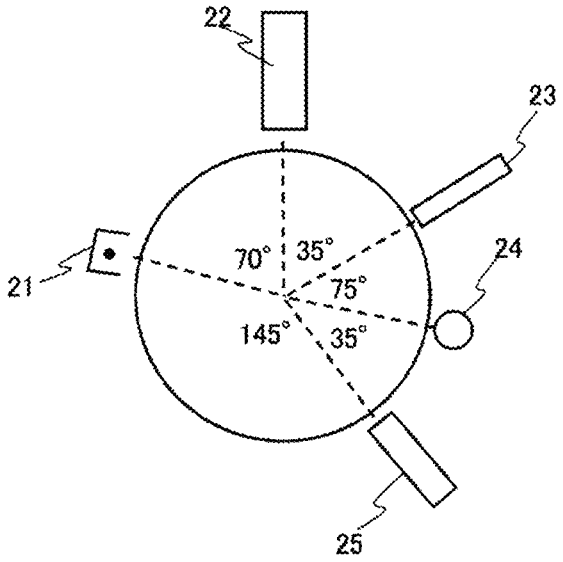
FIG. 7 is a process layout plan used to measure reversal potential after transfer.

In this regard, oppositely charged potential, in other words, reversal potential after transfer shown in FIG. 6 can be measured using a simulator constituted as shown by the process layout plan in FIG. 7. In the drawing, reference numeral 21 is a charging member, 22 is an image exposure member, 23 is a development position probe, 24 is a transfer member, and 25 is a potential-after-transfer probe. An oppositely charged potential after transfer (reversal potential) is measured through the probe 25. Using the depicted simulator, for example, under the following measurement conditions, a potential reversed by a transfer electrode after light exposure can be measured:

Linear velocity: 110 mm/s (70 rpm);

Charging: adjusted so that the potential at developed portions with no light exposure could be 800 V;

Light exposure: 780 nm; Energy: 0.3 $\mu J/cm^2$;

Probe potential at developed portions: 800 V (with no light exposure), 120 to 140 V (with light exposure); and Transfer: urethane roller 10 mm in diameter, 40 mm in length; electric current value: −2.5 μA.

A photoconductor according to an embodiment of the present invention makes it possible to obtain the above-mentioned expected effect if the photoconductor has the anodic oxide coating 2 and the predetermined interlayer 3 provided between the electroconductive base member 1 and the photosensitive layer 4. The photoconductor has no particular restrictions other than that, and can be embodied in accordance with a conventional method.

(Electroconductive Base Member)

The electroconductive base member 1 serves as an electrode of the photoconductor and, at the same time, as a support for the layers constituting the photoconductor, and may be in any form such as a cylindrical shape, a plate shape, or a film shape. An aluminum-made base member is used as the electroconductive base member 1, on the surface of which the anodic oxide coating 2 is formed.

(Anodic Oxide Coating)

The anodic oxide coating 2 to be provided on the surface of the electroconductive base member 1 can be formed by dipping the electroconductive base member 1 in an electrolytic bath and carrying out electrolytic treatment in accordance with a conventional method, and treatment conditions and the like are not limited to particular ones. For example, any of the commonly used acids can be used for electrolytic treatment, and sulfuric acid in particular is preferably used. In addition, the conditions of an electrolyte solution are preferably: a free sulfuric acid concentration of 150 to 200 g/L, an aluminum ion concentration of 1 to 12 g/L, and a temperature within a range of from 15 to 25° C., particularly 20±0.5° C.

The anodic oxide coating needs to have a film thickness of 2 μm or more and 10 μm or less, suitably 4 μm or more and 9 μm or less, more suitably 4 μm or more and 8 μm or less. Too small a film thickness of the anodic oxide coating results in insufficient pressure resistance, and too large a film thickness results in more likelihood of causing cracks in a drying step and thus tends to result in insufficient pressure resistance. In addition, the film thickness of the coating is determined in accordance with the electric current density and the treatment time, as above-mentioned, and thus, the electric current density and electrically conducting time during treatment can be set, as appropriate, in accordance with a desired coating thickness, and are not limited to particular values. It is preferable that the electric current density is 0.5 to 1.5 $A/dm^2$, and that the electrically conducting time is within a range of from 15 to 35 minutes. For an electrode, a lead sheet or a carbon sheet which is not attacked by sulfuric acid is preferably used.

After forming the anodic oxide coating 2, sealing treatment can be carried out. The sealing treatment is conditioned preferably at 60 to 95° C., more preferably at a temperature of 70 to 90° C., preferably within a range of from 10 to 30 minutes, whether nickel acetate or pure water is used as a sealing treatment agent. Examples of surfactants used for sealing treatment include a phosphate ester, a formaldehyde condensate of naphthalenesulfonic acid, a formaldehyde condensate of naphthalenesulfonic acid of bisphenol A, and the like, and these preferably have a concentration of 0.5 to 20 mL/L, more preferably 1 to 5 mL/L.

(Interlayer)

The interlayer 3 contains a vinyl chloride-vinyl acetate copolymer resin. The interlayer 3 may contain a vinyl chloride-vinyl acetate copolymer resin as a main component. The vinyl chloride-vinyl acetate copolymer resin may be a copolymer of vinyl chloride and vinyl acetate or a copolymer of vinyl chloride, vinyl acetate, and a functional group. The functional group is, for example, a vinyl alcohol, dicarboxylic acid, or hydroxyalkylacrylate. The composition ratio (mass %) of vinyl chloride to vinyl acetate may be in a range of from 79:21 to 99:1. The composition ratio is more preferably in a range of from 87:13 to 99:1. The vinyl chloride-vinyl acetate copolymer resin may contain a functional group the concentration of which is 4 to 12 mass %, preferably 5 to 11 mass %. The vinyl chloride-vinyl acetate copolymer resin content of the interlayer 3 may be 87 to 100 mass %. The interlayer 3 may contain a resin or an additive other than a vinyl chloride-vinyl acetate copolymer resin. The resin is, for example, acryl. The additive is, for example, a metal oxide such as titanium dioxide or zinc oxide. The interlayer 3 needs to have a film thickness of 0.02 μm or more and 0.3 μm or less, preferably 0.05 μm or more and 0.15 μm or less. Causing the interlayer 3 to have a film thickness of 0.02 μm or more and 0.3 μm or less makes it possible to suppress both solid density nonuniformity and ghost image generation in a favorable manner (Photosensitive Layer)

The photosensitive layer 4 contains a charge transport layer 4-1 and a charge generation layer 4-2 which are laminated in this order from the electroconductive base member 1 side.

[Charge Transport Layer]

The charge transport layer 4-1 contains a charge transport material and a resin binder.

Examples of hole transport materials that can be used as charge transport materials for the charge transport layer 4-1 include a hydrazone compound, pyrazoline compound, pyrazolone compound, oxadiazole compound, oxazole compound, arylamine compound, benzidine compound, stilbene compound, styryl compound, poly-N-vinylcarbazole, polysilane, and the like, and among these, an arylamine compound is preferable. These hole transport materials can be used singly or in combination of two or more kinds thereof. Preferable as hole transport materials are ones which not only have an excellent capability of transporting holes generated during light irradiation but also are suitable in combination with a charge generation material.

Examples of suitable hole transport materials include an arylamine compound represented by the following formulae (HT1) to (HT7). Using an arylamine compound for a hole transport material is more suitable in terms of environmental characteristics stability. In addition, examples include those represented by the following formulae (HT8) to (HT11).

HT1
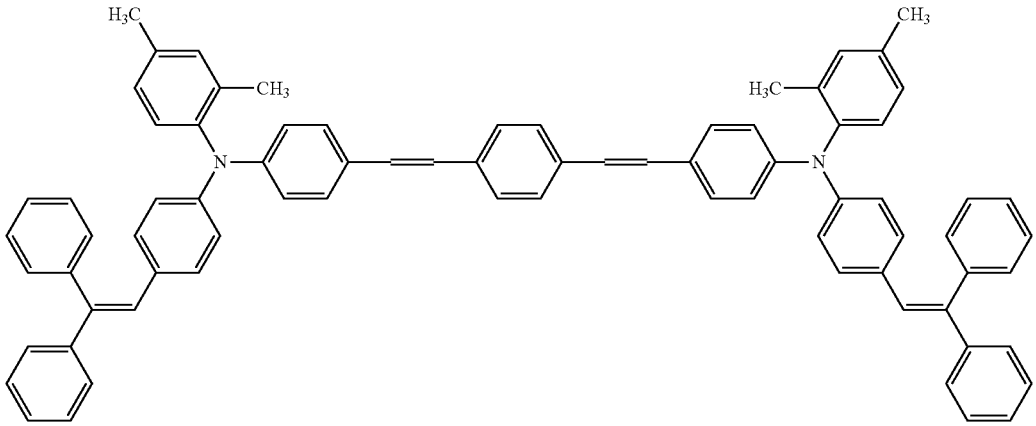
HT2
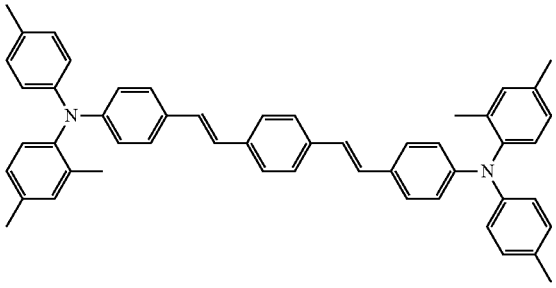
HT3
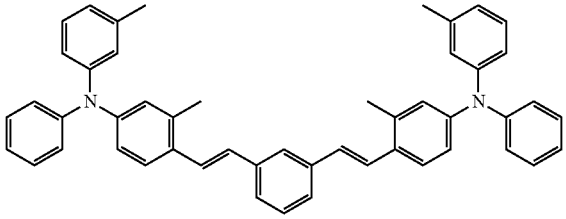
HT4
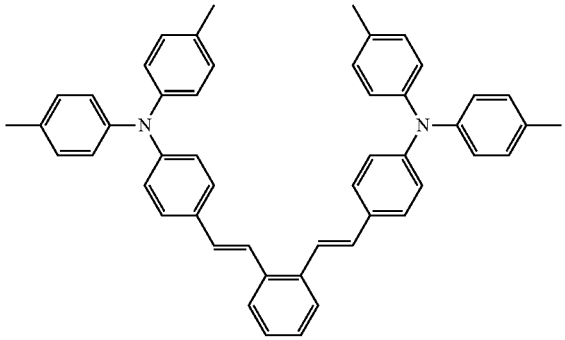
HT5
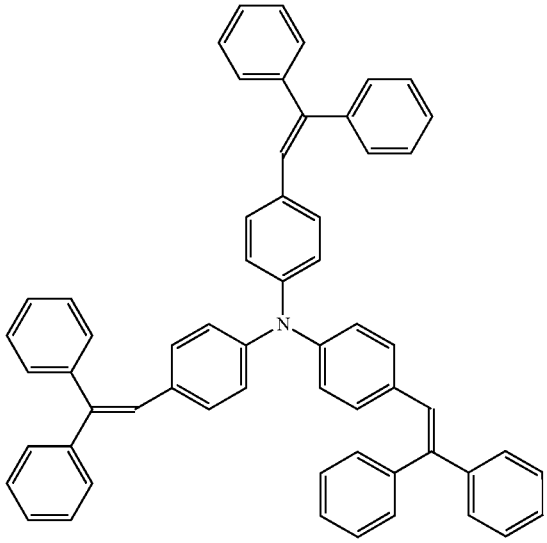

-continued

HT6

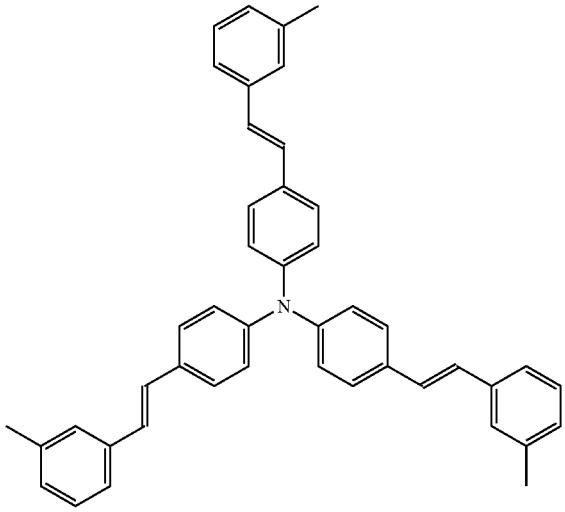

HT7

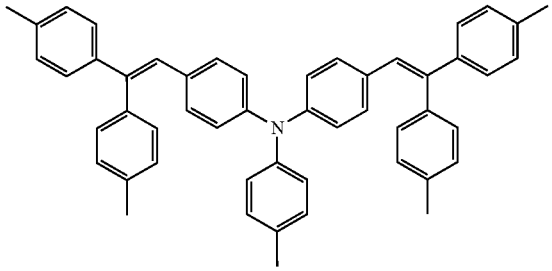

HT8

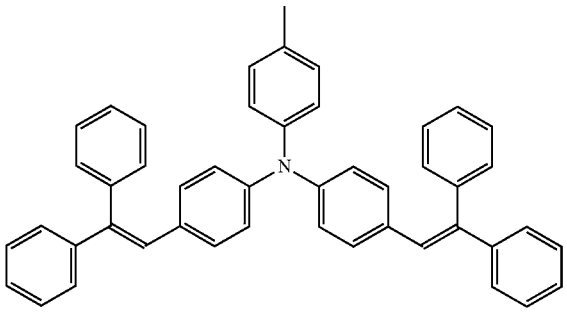

HT9

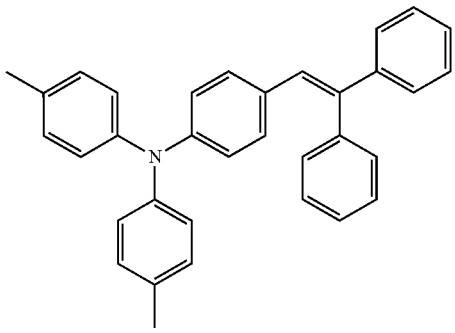

HT10

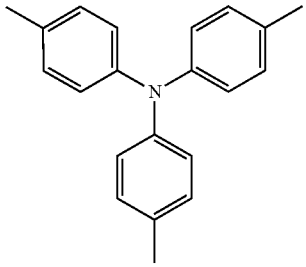

HT11

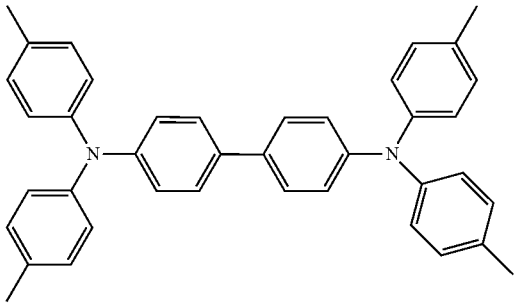

Examples of resin binders that can be used for the charge transport layer 4-1 include: various other types of polycarbonate resins such as a bisphenol A type, bisphenol Z type, bisphenol A type-biphenyl copolymer, and bisphenol Z type-biphenyl copolymer; a polyphenylene resin, polyester resin, polyvinyl acetal resin, polyvinyl butyral resin, polyvinyl alcohol resin, vinyl chloride resin, vinyl acetate resin, polyethylene resin, polypropylene resin, acryl resin, polyurethane resin, epoxy resin, melamine resin, silicone resin, polyamide resin, polystyrene resin, polyacetal resin, polyalylate resin, polysulfone resin, methacryl acid ester polymer, and copolymers thereof; and the like. Furthermore, a mixture of the same types of resins having different molecular weights may be used.

Examples of suitable resin binders include resins having a repeating unit represented by the following general formula (1). More specific examples of suitable resin binders include polycarbonate resins having a repeating unit represented by the following structural formulae (GB1) to (GB3):

(1)

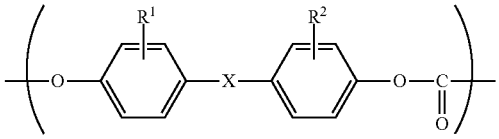

(wherein $R^1$ and $R^2$ are each a hydrogen atom, methyl, or ethyl; X is an oxygen atom, sulfur atom, or —$CR^3R^4$; $R^3$ and $R^4$ are each a hydrogen atom, $C_1$-$C_4$ alkyl, or phenyl optionally having a substituent; or $R^3$ and $R^4$ may be cyclicly bound to form a cycloalkyl group optionally having a $C_4$-$C_6$ substituent; and $R^3$ and $R^4$ may be the same or different).

GB1

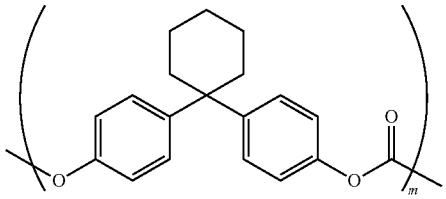

GB2

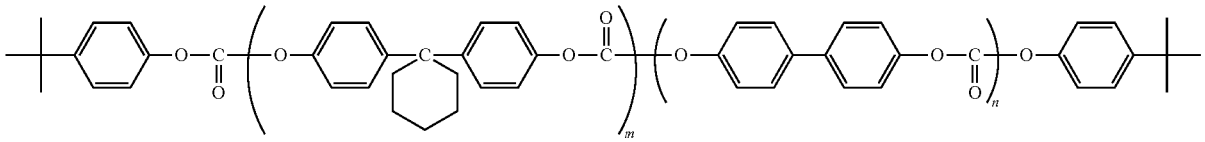

m:n = 85:15

GB3

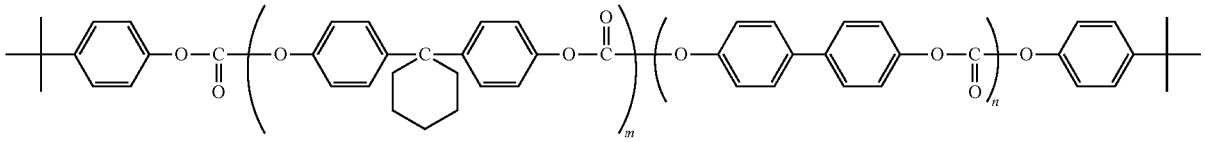

m:n = 60:40

The charge transport material content of the charge transport layer 4-1 is suitably 10 to 80 mass %, more suitably 20 to 70 mass %, with respect to the solid content of the charge transport layer 4-1. The resin binder content of the charge transport layer 4-1 is suitably 20 to 90 mass %, more suitably 30 to 80 mass %, with respect to the solid content of the charge transport layer 4-1.

[Charge Generation Layer]

The charge generation layer 4-2 contains a charge generation material, a hole transport material, an electron transport material, and a resin binder.

The charge generation material in the charge generation layer 4-2 is not limited to a particular one as long as the material has photosensitivity to a wavelength of an exposure light source, and examples of materials that can be used include organic pigments such as a phthalocyanine pigment, azo pigment, quinacridone pigment, indigo pigment, perylene pigment, perinone pigment, squarylium pigment, thiapyrylium pigment, polycyclic quinone pigment, anthanthrone pigment, and benzimidazole pigment. In particular, examples of phthalocyanine pigments include metal-free phthalocyanine, titanylphthalocyanine, chlorogallium phthalocyanine, hydroxygallium phthalocyanine, and copper phthalocyanine, examples of azo pigments include a disazo pigment and trisazo pigment, and examples of perylene pigments include N,N'-bis(3,5-dimethylphenyl)-3,4:9,10-perylene-bis(carboxyimide). Among these, examples of metal-free phthalocyanines that can be used include X type metal-free phthalocyanine, τ type metal-free phthalocyanine, and the like, and examples of titanylphthalocyanines that can be used include α type titanylphthalocyanine, β type titanylphthalocyanine, Y type titanylphthalocyanine, amorphous type titanylphthalocyanine, titanylphthalocyanine which has the maximum peak at a Bragg angle 2θ of 9.6° in a CuKα:X-ray diffraction spectrum as described in JP08-209023A, U.S. Pat. Nos. 5,736,282A, and 5,874,570A, and the like. In particular, titanylphthalocyanine is preferably used. For the charge generation material, any one type of the above-mentioned can be used, or two or more types may be used in combination.

Hole transport materials that can be used for the charge generation layer 4-2 are the same as those exemplified for the charge transport layer 4-1, and are not limited to particular ones. In particular, as a hole transport material in the charge generation layer 4-2, one having an ionization potential Ip of 5.4 eV or less, particularly 5.25 eV or more and 5.39 eV or less, is preferably used, and one having a mobility of $2\times10^{-5}$ $cm^2/V\cdot s$ or more, particularly $3\times10^{-5}$ $cm^2/V\cdot s$ or more, is preferably used. Examples of hole transport materials that satisfy such an ionization potential or mobility include arylamine compounds represented by the structural formulae (HT1), (HT2), and (HT4). This makes it possible to effectively suppress generation of ghost images and nonuniformity of solid black density. Here, the above-mentioned mobility means hole mobility. Hole mobility can be measured using a coating liquid obtained by adding a hole transport material at 50 mass % in a resin binder. The ratio of the hole transport material to the resin binder is 50:50. The resin binder may be a bisphenol Z type polycarbonate resin. For example, it may be Iupizeta PCZ-500 (tradename; manufactured by Mitsubishi Gas Chemical Company, Inc.). Specifically, a coating liquid is applied to a base member and dried at 120° C. for 30 minutes to make a coating film having a film thickness of 7 μm, and the hole mobility can be measured at a constant electric field intensity of 20 V/μm using a TOF (Time of Flight) method. The measurement temperature is 300K.

An electron transport material in the charge generation layer 4-2 is not limited to a particular one, and examples of such materials that can be used include succinic anhydride, maleic anhydride, dibromo-succinic anhydride, phthalic anhydride, 3-nitro-phthalic anhydride, 4-nitro-phthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, azoquinone compounds, naphthalenetetracarboxylic diimide compounds, and the like.

As a naphthalenetetracarboxylic diimide compound among the above-mentioned materials, one which is represented by the following general formula (2) can suitably be used:

(2)

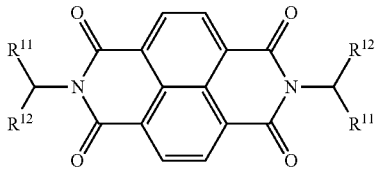

(wherein $R^{11}$ and $R^{12}$, which may be the same or different, each represent a hydrogen atom, $C_1$-$C_{10}$ alkyl, alkylene, alkoxy, alkyl ester, phenyl optionally having a substituent, naphthyl optionally having a substituent, or halogen element; and $R^{11}$ and $R^{12}$ may be bound to each other to form an aromatic ring optionally having a substituent).

Specific examples of naphthalenetetracarboxylic diimide compounds represented by the above-mentioned general formula (2) as electron transport materials include compounds represented by the following structural formulae (ET1) to (ET4), (ET9), and (ET10). In addition, specific examples of azoquinone compounds, diphenoquinone compounds, and stilbenequinone compounds include compounds represented by the following structural formulae (ET5) to (ET8).

ET1

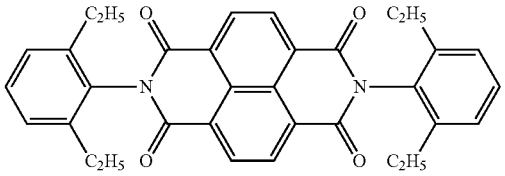

ET2

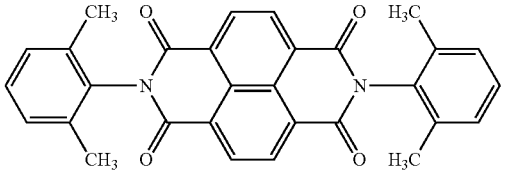

-continued

ET3

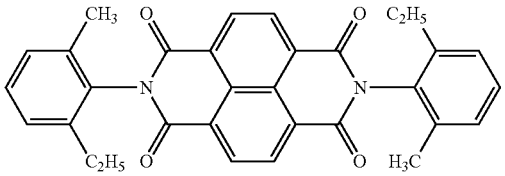

ET4

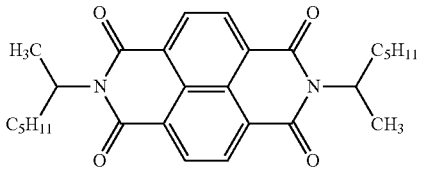

ET5

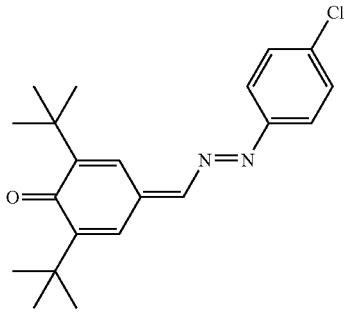

ET6

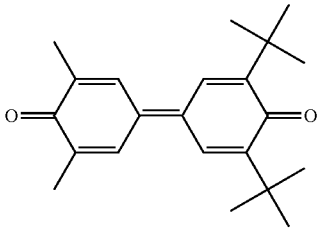

ET7

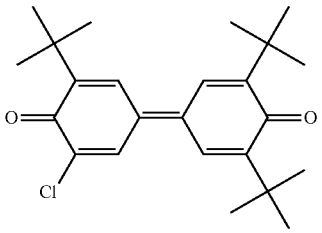

ET8

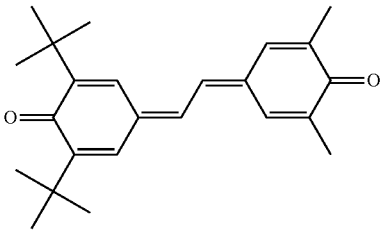

ET9

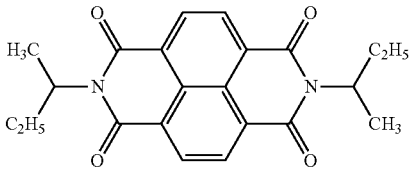

-continued

ET10

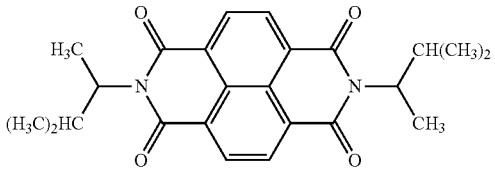

In particular, it is preferable that the first and second electron transport materials are used as electron transport materials, that a naphthalenetetracarboxylic diimide compound is used as the first electron transport material, and that, as the second electron transport material, an azoquinone compound, diphenoquinone compound, or stilbenequinone compound having a mobility of $17\times10^{-8}$ $cm^2/V\cdot s$ or more is used. Using a naphthalenetetracarboxylic diimide compound as the first electron transport material makes it possible to afford a photoconductor having excellent stability of potential against environmental changes and having favorable performance in terms of sebum crack resistance. As the first electron transport material, any of the compounds represented by the above-mentioned structural formulae (ET1) to (ET4) is preferable. In addition, using, as the second electron transport material, an azoquinone compound, diphenoquinone compound, or stilbenequinone compound having high mobility makes it possible to increase the mobility capability of injected charges and suppress generation of ghost images. As the second electron transport material, any of the compounds represented by the above-mentioned structural formulae (ET5) to (ET8) is preferable. Therefore, using such a combination of two types of electron transport materials affords a photoconductor that makes it possible to obtain stable image quality causing no generation of ghost images and transfer defects under diverse environments. The two types of electron transport materials are selected from the combinations: the above-mentioned structural formulae (ET1) and (ET5), the above-mentioned structural formulae (ET1) and (ET7), the above-mentioned structural formulae (ET2) and (ET6), the above-mentioned structural formulae (ET3) and (ET8), and the above-mentioned structural formulae (ET4) and (ET5). Preferably, the two types of electron transport materials are selected from any of the combinations: the above-mentioned structural formulae (ET1) and (ET5), the above-mentioned structural formulae (ET1) and (ET7), and the above-mentioned structural formulae (ET4) and (ET5). Furthermore, the ratio of the second electron transport material content to the first electron transport material/second electron transport material content is in a range of from 3 to 40 mass %, particularly in a range of from 10 to 35 mass %.

The mobility of an azoquinone compound, diphenoquinone compound, or stilbenequinone compound as the second electron transport material is specifically an electron mobility at an electric field intensity of 20 V/μm, and is preferably $17\times10^{-8}$ $cm^2/V\cdot s$ or more. Here, the electron mobility can be measured using a coating liquid obtained by adding an electron transport material at 50 mass % in a resin binder. The ratio of the electron transport material to the resin binder is 50:50. The resin binder may be a bisphenol Z type polycarbonate resin. For example, it may be Iupizeta PCZ-500 (tradename; manufactured by Mitsubishi Gas Chemical Company, Inc.). Specifically, a coating liquid is applied to a base member and dried at 120° C. for 30 minutes to make a coating film having a film thickness of 7 μm, and the electron mobility can be measured at a given electric field intensity of 20 V/μm using a TOF (Time of Flight) method. The measurement temperature is 300K.

The charge generation material content of the charge generation layer 4-2 is suitably 0.1 to 5 mass %, more suitably 0.5 to 3 mass %, with respect to the solid content of the charge generation layer 4-2. The hole transport material content of the charge generation layer 4-2 is suitably 1 to 30 mass %, more suitably 5 to 20 mass %, with respect to the solid content of the charge generation layer 4-2. The electron transport material content of the charge generation layer 4-2 is suitably 5 to 60 mass %, more suitably 10 to 40 mass %, with respect to the solid content of the charge generation layer 4-2. The content ratio of the hole transport material to the electron transport material may be in a range of from 1:3 to 1:10. The electron transport material contains a first electron transport material and a second electron transport material. The electron transport material may further contain a third electron transport material different from the first and the second electron transport material. The third electron transport material content is suitably 0 to 20 mass % with respect to the solid content of the charge generation layer 4-2. The resin binder content of the charge generation layer 4-2 is suitably 20 to 80 mass %, more suitably 30 to 70 mass %, with respect to the solid content of the charge generation layer 4-2.

It is preferable that the film thicknesses of the charge transport layer 4-1 and the charge generation layer 4-2 are not limited to particular values, and are each 5 μm or more and 25 μm or less, and that the photosensitive layer has a total film thickness of 15 μm or more and 50 μm or less. Too small a film thickness of the charge transport layer causes the film thickness of the charge generation layer to be relatively large, thus upsets a transport balance between holes and electrons, worsens environmental variation and repetition stability, and makes it more difficult to obtain stable image quality. In addition, too large a thickness causes the film thickness of the charge generation layer to be relatively small, causes the entire film thickness of the photosensitive layer to be relatively large, thus decreases the toner layer thickness on the surface of the photoconductor, and makes it more difficult to obtain gradation. In addition, too small a total film thickness decreases charge potential and makes it more likely to generate fogging, and too large a total film thickness decreases the toner layer thickness and makes it more likely to impair gradation.

The photosensitive layer in the photoconductor according to an embodiment of the present invention can contain a leveling agent such as silicone oil or fluorine oil for the purposes of enhancing the leveling properties of the formed film and imparting lubricity. Furthermore, the photosensitive layer can contain a plurality of inorganic oxides for the purposes of adjusting film hardness, decreasing friction coefficient, imparting lubricity, and the like. The photosensitive layer may contain: microparticles of a metal oxide such as silica, titanium oxide, zinc oxide, calcium oxide, alumina, or zirconium oxide, a metal sulfate such as barium sulfate or calcium sulfate, or a metal nitride such as silicon nitride or aluminum nitride; particles of a fluorine resin such as an ethylene tetrafluoride resin; or particles of a fluorine comb-type graft polymer resin; and the like. Furthermore, the photosensitive layer can contain another known additive, if necessary, to the extent that the electrophotographic characteristics are not impaired significantly.

In addition, the photosensitive layer can contain an antidegradant such as an antioxidant or a light stabilizer for the purposes of enhancing environmental resistance and stability against harmful light. Examples of compounds used for such a purpose include: a chromanol derivative such as tocopherol; an esterified compound, polyarylalkane compound, hydroquinone derivative, etherified compound, dietherified compound, benzophenone derivative, benzotriazole derivative, thioether compound, phenylene diamine derivative, phosphonate ester, phosphite ester, phenol compound, hindered phenol compound, linear amine compound, cyclic amine compound, and hindered amine compound; and the like.

(Method of Producing Photoconductor)

In producing the above-mentioned photoconductor for electrophotography, a method of producing a photoconductor according to an embodiment of the present invention includes a step of forming a charge transport layer and a charge generation layer in this order on an interlayer using a dip coating method.

Specifically, an anodic oxide coating is first formed on the surface of an electroconductive base member by a conventional method. Next, an interlayer having a predetermined film thickness is formed by a method including: a step of dissolving a vinyl chloride-vinyl acetate copolymer resin in a solvent to prepare a coating liquid for forming an interlayer; and a step of applying this coating liquid for forming an interlayer to the outer surface of an anodic oxide coating on the surface of the electroconductive base member by a dip coating method, and drying the coating liquid to form an interlayer. Next, a charge transport layer is formed by a method including: a step of dissolving any hole transport material and any resin binder in a solvent to prepare a coating liquid for forming a charge transport layer; and a step of applying this coating liquid for forming a charge transport layer to the above-mentioned interlayer by a dip coating method, and drying the coating liquid to form a charge transport layer. Next, a charge generation layer is formed by a method including: a step of dissolving and dispersing any charge generation material, any electron transport material, any hole transport material, and any resin binder in a solvent to prepare a coating liquid for forming a charge generation layer; and a step of applying this coating liquid for forming a charge generation layer to the above-mentioned charge transport layer by a dip coating method, and drying the coating liquid to form a charge generation layer. A layered photoconductor according to the embodiment can be produced by such a production method. Here, the type of a solvent for preparing a coating liquid, coating conditions, drying conditions, and the like can be selected as appropriate on the basis of a conventional method, and are not limited to particular ones.

(Electrophotographic Device)

A photoconductor for electrophotography according to an embodiment of the present invention is used for various machine processes to obtain an expected effect. Specifically, a sufficient effect can be obtained in a charging process such as by a contact charging method using a charging member such as a roller or a brush, or by a noncontact charging method using corotron, scorotron, and the like, and in a development process such as by a contact development method and noncontact development method using a developer such as a nonmagnetic one-component, magnetic one-component, or two-component one.

An electrophotographic device according to an embodiment of the present invention is a tandem type of device for color printing, having the above-mentioned photoconductor for electrophotography mounted therein and having a printing speed of 24 ppm or more. In addition, an electrophotographic device according to another embodiment of the present invention has the above-mentioned photoconductor for electrophotography mounted therein and has a printing speed of 40 ppm or more. A high-speed machine requiring high charge transport performance in the photosensitive layer, a tandem color machine significantly affected by discharge gas, or the like is a device the photoconductor of which is heavily used, and among these, a device having a short processing time is considered more likely to cause space charge to be accumulated. Such an electrophotographic device is more likely to generate ghost images, and therefore, it is more useful to use the present invention for such a device. In particular, an electrophotographic device of a tandem type for color printing and an electrophotographic device having no erasing member are more likely to generate ghost images, and therefore, it is more useful to use the present invention for such a device.

Figure 3:
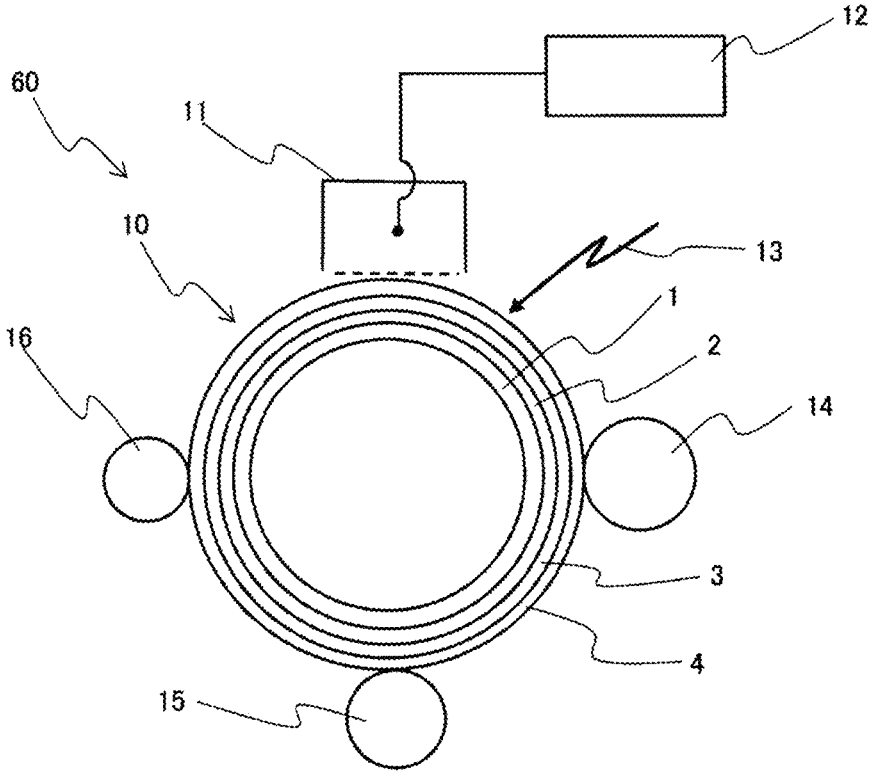
FIG. 3 is a schematic block diagram depicting an example of an electrophotographic process layout plan for an electrophotographic device according to the present invention.

FIG. 3 shows a schematic block diagram depicting an example of an electrophotographic process layout plan for an electrophotographic device according to the present invention. The depicted electrophotography process represents a black and white high-speed printer. The depicted electrophotographic device 60 has a photoconductor 10 according to an embodiment of the present invention mounted therein, wherein the photoconductor 10 includes an electroconductive base member 1, an anodic oxide coating 2 covering the outer surface of the base member 1, an interlayer 3, and a photosensitive layer 4 composed of a charge transport layer and a charge generation layer. This electrophotographic device 60 includes a charging member 11 disposed on an edge of the outer surface of the photoconductor 10, a charging power supply 12 for supplying applied voltage to the charging member 11, an image exposure member 13, a development member 14, and a transfer member 15. The electrophotographic device 60 may further include a cleaning member 16.

Figure 4:
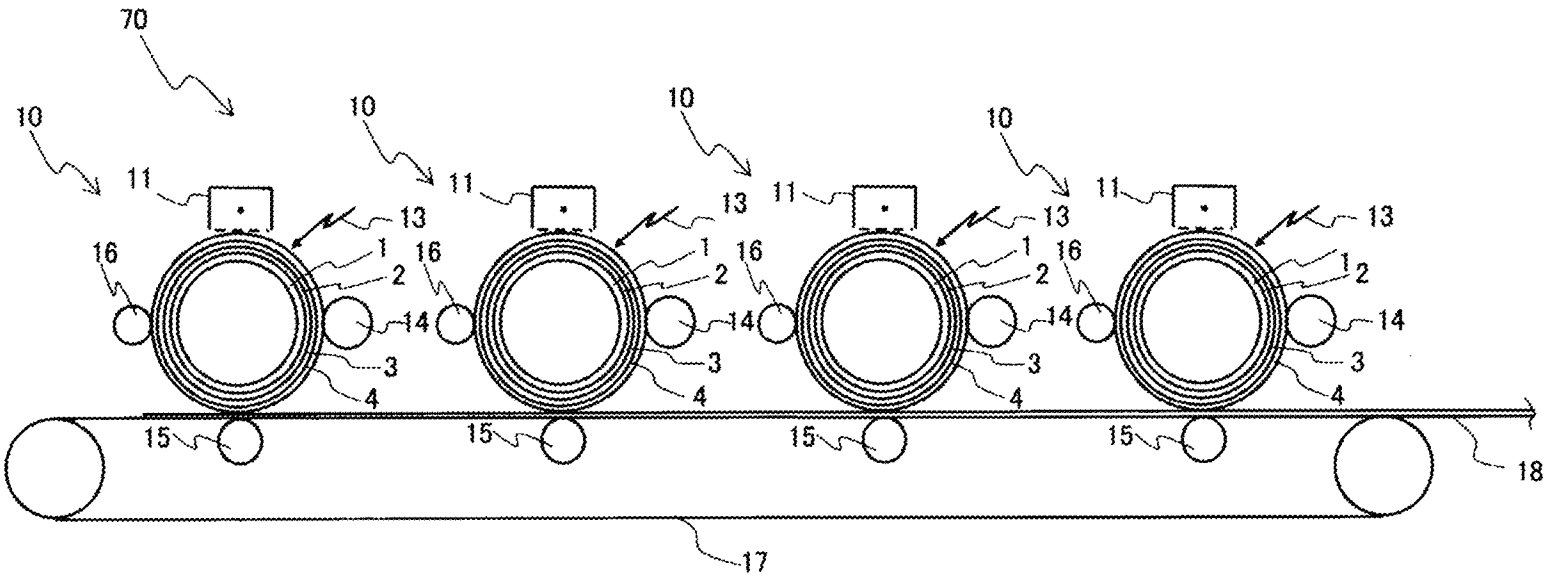
FIG. 4 is a schematic block diagram depicting another example of an electrophotographic process layout plan for an electrophotographic device according to the present invention.

FIG. 4 shows a schematic block diagram depicting another example of an electrophotographic process layout plan for an electrophotographic device according to the present invention. The depicted electrophotography process represents a tandem color printer. The depicted electrophotographic device 70 has four photoconductors 10 according to an embodiment of the present invention mounted therein, wherein the photoconductor 10 includes an electroconductive base member 1, an anodic oxide coating 2 covering the outer surface of the base member 1, an interlayer 3, and a photosensitive layer 4 composed of a charge transport layer and a charge generation layer. This electrophotographic device 70 includes a charging member 11 disposed on an edge of the outer surface of the photoconductor 10, an unshown charging power supply for supplying applied voltage to the charging member 11, an image exposure member 13, a development member 14, a transfer member 15, a transfer belt 17, and a substrate 18. The electrophotographic device 70 may further include a cleaning member 16.

EXAMPLES

Below, specific aspects of the present invention will be described in more detail with reference to Examples. The present invention is not limited by the following Examples as far as it does not depart from the gist thereof. In addition, "%" in the below-mentioned tables means mass %.

Example 1

As electroconductive base members, two types of aluminum-made element pipes cut to a surface roughness (Rmax) of 0.2 μm and having a thickness of 0.75 mm were used, wherein one was in the form 30 mm in diameter and 244.5 mm in length, and the other was in the form 30 mm in diameter and 254.4 mm in length. An anodic oxide coating was formed on each of these two types of electroconductive base members by a conventional method. A pure water sealing treatment, during which the electric current density was 0.5 A/dm$^2$, and the electrically conducting time was 15 minutes, was carried out at 95° C. for 30 minutes to obtain an anodic oxide coating having a thickness of 2 μm.

One part by mass of vinyl chloride-vinyl acetate copolymer resin shown in the below-mentioned Table 3 was dissolved in 2000 parts by mass of methylethylketone as a solvent to prepare a coating liquid for forming an interlayer. This coating liquid for forming an interlayer was applied to the above-mentioned anodic oxide coating on the surface of the electroconductive base member by a dip coating, and dried at 90° C. for 15 minutes to form an interlayer having a film thickness of 0.02 μm.

[Charge Transport Layer]

A compound used as a hole transport material and represented by the above-mentioned structural formula (HT1) and a polycarbonate resin used as a resin binder and having a repeating unit represented by the above-mentioned structural formula (GB1) were dissolved in tetrahydrofuran in accordance with the formulation amounts shown in the below-mentioned Table 3 to prepare a coating liquid. This coating liquid was applied to the above-mentioned electroconductive base member by a dip coating, and dried at 100° C. for 30 minutes to form a charge transport layer having a film thickness of 10 μm.

[Charge Generation Layer]

A compound used as a hole transport material and represented by the above-mentioned structural formula (HT1), a compound used as a first electron transport material and represented by the above-mentioned structural formula (ET1), a compound used as a second electron transport material and represented by the above-mentioned structural formula (ET5), and a polycarbonate resin (having a molecular weight of 50000 in terms of viscosity) used as a resin binder and having a repeating unit represented by the above-mentioned structural formula (GB1) were dissolved in tetrahydrofuran in accordance with the formulation amounts shown in the below-mentioned Table 3, and to the resulting solution, titanylphthalocyanine used as a charge generation substance and represented by the following structural formula (CG1) was added, followed by a disperse treatment carried out using a sand grind mill, to prepare a coating liquid. This coating liquid was applied to the above-mentioned charge transport layer by a dip coating method, and dried at a temperature of 110° C. for 30 minutes to form a charge generation layer having a film thickness of 15 μm, and thus, a layered photoconductor for electrophotography containing a photosensitive layer having a film thickness of 25 μm was obtained.

CG1

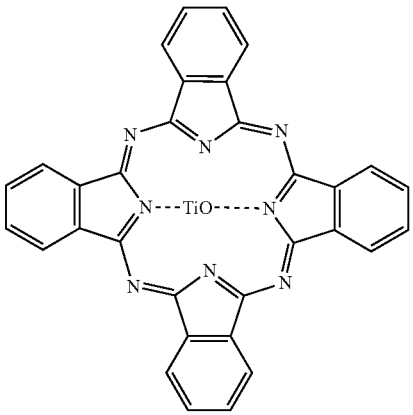

Examples 2 to 27 and Comparative Examples 1 to 22

Layered photoconductors for electrophotography were produced in the Examples and Comparative Examples in the same manner as in Example 1 except that, in accordance with the conditions shown in the below-mentioned Tables 3 to 5, changes were made in the film thickness of an anodic oxide coating, the material and film thickness of an interlayer, the material, formulation amount, and film thickness of a charge transport layer, and the material, formulation amount, and film thickness of a charge generation layer.

In this regard, the film thickness of an interlayer was measured by a gravimetric method. First, a cylindrical aluminum base member with an anodic oxide coating provided thereon was measured using an electronic balance. Next, an interlayer film was formed through a dip coating step and the subsequent drying step, followed by wiping the inner surface with a solvent, and then the weight was measured in the same manner. This weight difference was divided by the area to calculate the film thickness. Here, the specific gravity of the resin was defined as 1.

In addition, the film thickness of the anodic oxide coating was measured using a contact type film thickness meter. An eddy-current type film thickness meter (MULTI MEASURING SYSTEM) manufactured by Fischer Instruments K.K. was adjusted for zero point using an aluminum base member having no anodic oxide coating, and calibrated using the base member on which a Mylar film having a film thickness of 25 μm was placed. A total of nine points on the base member treated to have an anodic oxide coating were measured: three points in the circumferential direction at a position 30 mm inward from the upper end; three points in the circumferential direction at a position 30 mm inward from the lower end; and three points in the circumferential direction at a position central in the axial direction. The average value was regarded as the film thickness.

Furthermore, the ionization potential Ip and mobility of the hole transport material used and the mobility of the electron transport material used were measured as in the below-mentioned manner. The results are shown in the below-mentioned Tables 1 and 2.

[Photoconductor]

Electroconductive base member: an A3000 aluminum element pipe, 30 mm in diameter×244.5 mm in length, and 0.5 mm in thickness, was used.

Interlayer: the electroconductive base member was coated, by dip coating, with a coating liquid obtained by dissolving a polyamide resin (CM8000) manufactured by Toray Industries, Inc. at a solid concentration of 3% in a solution mixture of methanol and butanol (at a mixing ratio of 1:1), and the coating liquid was dried with hot air at 90° C. for 30 minutes to form an interlayer having a thickness of 0.1 μm.

Charge generation layer: a butyral resin (S-LEC B BX-L) manufactured by Sekisui Chemical Co., Ltd. was dissolved at a solid concentration of 2 mass % in a tetrahydrofuran (THF) solvent, and with the resulting solution, the same amount of titanylphthalocyanine was mixed, and dispersed using a ball mill to obtain a coating liquid, with which the electroconductive base member having the interlayer provided thereon was coated by dip coating, followed by drying with hot air at 90° C. for 30 minutes, to form a charge generation layer having a film thickness of 0.5 μm.

Charge transport layer: a polycarbonate resin (Iupizeta PCZ-500) manufactured by Mitsubishi Gas Chemical Company, Inc. was dissolved at a solid concentration of 10 mass % in a THF solvent, and with the resulting solution, the same amount of each charge transport material was mixed, and completely dissolved to obtain a coating liquid, with which the electroconductive base member having the interlayer and charge generation layer provided thereon was coated by dip coating, followed by drying with hot air at 120° C. for 30 minutes, to form a charge transport layer having a film thickness of 20 μm.

[Mobility]

The mobility was measured in the following manner.

First, each transport material was dissolved at 50 mass % in a polycarbonate resin: Iupizeta PCZ-500 (tradename; manufactured by Mitsubishi Gas Chemical Company, Inc.) to obtain a coating liquid.

The coating liquid was applied to the base member and dried with hot air at 120° C. for 30 minutes to produce a 7 μm coating film. This sample was measured for mobility at an electric field intensity of 20 V/μm under a 300K measurement environment using a TOF (Time of Flight) method.

[Ionization Potential]

Under the below-mentioned conditions, each charge transport material was measured for ionization potential using a surface analysis device AC-2 manufactured by Riken Keiki Co., Ltd. (which is a device for analyzing the surface of a sample by counting photoelectrons caused by ultraviolet excitation in the atmosphere, and for which a low-energy electronic counting device is used).

Temperature and relative humidity in the environment during measurement: 25° C., 50%

Counting time: 10 seconds/one point

Light amount setting: 50 μW/cm$^2$

Energy scanning range: 3.4 to 6.2 eV

Ultraviolet spot size: 1 mm square

Unit photon: $1\times10^{14}$ pieces/cm$^2$·second

TABLE 1

| Hole Transport Material (HTM) | Mobility × $10^{-6}$ (cm$^2$/V · s) | Ip (eV) |
|---|---|---|
| HT1 | 75.2 | 5.39 |
| HT2 | 34.5 | 5.25 |
| HT4 | 15.2 | 5.46 |
| HT8 | 18.9 | 5.55 |
| HT11 | 13 | 5.19 |

TABLE 2

| Electron Transport Material (ETM) | Mobility × $10^{-8}$ (cm$^2$/V · s) |
|---|---|
| ET1 | 19 |
| ET4 | 18 |
| ET5 | 17 |
| ET7 | 32 |

(Evaluation of Photoconductor)

A photoconductor from each of Examples and Comparative Examples was incorporated in a commercially available black and white high-speed printer HL-L5200DW (having a printing speed of 40 ppm) and tandem color printer HL-L3230CDW (having a printing speed of 24 ppm), which are manufactured by Brother Industries, Ltd., and was evaluated using images printed under three kinds of environments: 10° C. and 20% (LL: low temperature and low humidity); 25° C. and 50% (NN: normal temperature and normal humidity); and 35° C. and 85% (HH: high temperature and high humidity).

[Evaluation of Ghost Image]

Figure 5:
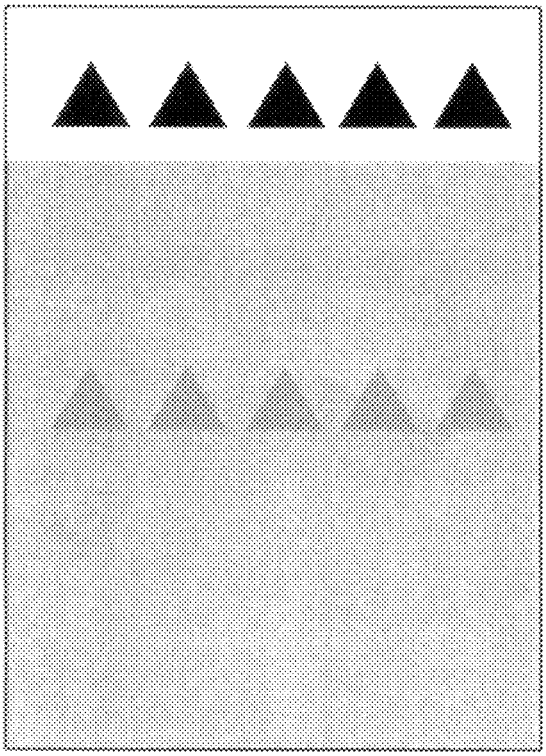
FIG. 5 is an explanatory drawing depicting a half-tone image used to evaluate a ghost image.

A black half-tone (1 on 2 off) image was printed under the HH environment as shown in FIG. 5 and evaluated for generation of negative ghost images due to transfer influence. The results are shown as ○ for an unrecognizable ghost, as Δ for a recognizable ghost, and as x for a clearly recognized ghost.

[Evaluation of Solid Black Density Nonuniformity]

A black solid image was printed under the HH environment, and the image density was measured using a Macbeth densitometer. Image densities were measured at three places in the denser portion of the black solid image: 30 mm inward from the left end, 30 mm inward from the right end, and in the central portion in the paper width direction corresponding to the longitudinal direction of the photoconductor; and the average density was taken. Image densities were measured at three places in the thinner portion in the same manner, and the average density was taken. The difference between the average densities was used to evaluate density nonuniformity (nonuniformity), and the transfer defect due to transfer influence was determined. The results are shown as ○ for a density nonuniformity of less than 0.02, as Δ for 0.02 or more and less than 0.05, and as x for 0.05 or more.

[Evaluation of Black Spots (Color Spots)]

Under the LL environment, an image in which the printing area of each color was 1% was intermittently printed in two-sheet intermittent pattern on up to 10K sheets, and generation of black spots due to leakage was determined. The results are shown as ○ for generation of no color spot (black spot) 0.1 mm or more in diameter, as Δ for generation of one color spot (black spot) 0.1 mm or more and less than 0.3 mm in diameter, and as x for generation of two or more color spots (black spots) 0.1 mm or more and less than 0.3 mm in diameter or generation of one or more color spots (black spots) 0.3 mm or more in diameter.

[Evaluation of Adhesion]

Under the NN environment, a 3 mm×3 mm crosshatch was incised on the surface of the photosensitive layer using a cutter, a 24 mm wide Cello-tape (registered trademark) manufactured by Nichiban Co., Ltd. was stuck on the surface, the surface was rubbed with an eraser back and forth ten times to increase the adhesion, and then, a tensile peeling test was carried out on the photosensitive layer in the circumferential direction. The results are shown as ○ for no peeling, as Δ for peeling of less than one cell, as x for peeling of one cell or more.

The results are shown in the below-mentioned Tables 6 to 8.

TABLE 3

| | Anodic Oxide Coating Film | Interlayer | | Charge Transport Layer | | | | | Charge Generation Layer | | | | | | | | | | |
|---|---|---|---|---|---|---|---|---|---|---|---|---|---|---|---|---|---|---|---|
| | | | | Hole Transport Material | | Resin Binder | | Film | Charge Generation Material | | Hole Transport Material | | First Electron Transport Material | | Second Electron Transport Material | | Resin Binder | | Film |
| | Thickness (μm) | Material *1 | Thickness (μm) | Material | Content (%) | Material | Content (%) | Thickness (μm) | Material | Content (%) | Material | Content (%) | Material | Content (%) | Material | Content (%) | Material | Content (%) | Thickness (μm) |
| Example 1 | 2 | A | 0.02 | HT1 | 50 | GB1 | 50 | 10 | CG1 | 1 | HT1 | 5.0 | ET1 | 39.6 | ET5 | 4.4 | GB1 | 50 | 15 |
| Example 2 | 2 | A | 0.15 | HT1 | 50 | GB1 | 50 | 10 | CG1 | 1 | HT1 | 5.0 | ET1 | 35.2 | ET5 | 8.8 | GB1 | 50 | 15 |
| Example 3 | 2 | A | 0.3 | HT1 | 50 | GB1 | 50 | 10 | CG1 | 1 | HT1 | 5.0 | ET1 | 28.6 | ET5 | 15.4 | GB1 | 50 | 15 |
| Example 4 | 2 | B | 0.02 | HT1 | 45 | GB1 | 55 | 12.5 | CG1 | 1.5 | HT2 | 6.9 | ET1 | 37.4 | ET5 | 4.2 | GB2 | 50 | 12.5 |
| Example 5 | 2 | B | 0.15 | HT1 | 45 | GB1 | 55 | 12.5 | CG1 | 1.5 | HT2 | 6.9 | ET1 | 33.3 | ET5 | 8.3 | GB2 | 50 | 12.5 |
| Example 6 | 2 | B | 0.3 | HT1 | 45 | GB1 | 55 | 12.5 | CG1 | 1.5 | HT2 | 6.9 | ET1 | 27.0 | ET5 | 14.6 | GB2 | 50 | 12.5 |
| Example 7 | 2 | C | 0.02 | HT1 | 40 | GB1 | 60 | 15 | CG1 | 2 | HT4 | 12.0 | ET1 | 32.4 | ET5 | 3.6 | GB3 | 50 | 10 |
| Example 8 | 2 | C | 0.15 | HT1 | 40 | GB1 | 60 | 15 | CG1 | 2 | HT4 | 12.0 | ET1 | 28.8 | ET5 | 7.2 | GB3 | 50 | 10 |
| Example 9 | 2 | C | 0.3 | HT1 | 40 | GB1 | 60 | 15 | CG1 | 2 | HT4 | 12.0 | ET1 | 23.4 | ET5 | 12.6 | GB3 | 50 | 10 |
| Example 10 | 10 | A | 0.02 | HT2 | 50 | GB2 | 50 | 10 | CG1 | 1 | HT1 | 5.0 | ET1 | 39.6 | ET7 | 4.4 | GB2 | 50 | 15 |
| Example 11 | 10 | A | 0.15 | HT2 | 50 | GB2 | 50 | 10 | CG1 | 1 | HT1 | 5.0 | ET1 | 35.2 | ET7 | 8.8 | GB2 | 50 | 15 |
| Example 12 | 10 | A | 0.3 | HT2 | 50 | GB2 | 50 | 10 | CG1 | 1 | HT1 | 5.0 | ET1 | 28.6 | ET7 | 15.4 | GB2 | 50 | 15 |
| Example 13 | 10 | B | 0.02 | HT2 | 45 | GB2 | 55 | 12.5 | CG1 | 1.5 | HT2 | 6.9 | ET1 | 37.4 | ET7 | 4.2 | GB1 | 50 | 12.5 |
| Example 14 | 10 | B | 0.15 | HT2 | 45 | GB2 | 55 | 12.5 | CG1 | 1.5 | HT2 | 6.9 | ET1 | 33.3 | ET7 | 8.3 | GB1 | 50 | 12.5 |
| Example 15 | 10 | B | 0.3 | HT2 | 45 | GB2 | 55 | 12.5 | CG1 | 1.5 | HT2 | 6.9 | ET1 | 27.0 | ET7 | 14.6 | GB1 | 50 | 12.5 |

TABLE 3-continued

| | Anodic Oxide Coating Film | Interlayer Film | | Charge Transport Layer Hole Transport Material | | Charge Transport Layer Resin Binder | | Charge Transport Layer Film | Charge Generation Layer Charge Generation Material | | Charge Generation Layer Hole Transport Material | | Charge Generation Layer First Electron Transport Material | | Charge Generation Layer Second Electron Transport Material | | Charge Generation Layer Resin Binder | | Charge Generation Layer Film |
|---|---|---|---|---|---|---|---|---|---|---|---|---|---|---|---|---|---|---|---|
| | Thickness (μm) | Material *1 | Thickness (μm) | Material | Content (%) | Material | Content (%) | Thickness (μm) | Material | Content (%) | Material | Content (%) | Material | Content (%) | Material | Content (%) | Material | Content (%) | Thickness (μm) |
| Example 16 | 10 | C | 0.02 | HT2 | 40 | GB2 | 60 | 15 | CG1 | 2 | HT4 | 12.0 | ET1 | 32.4 | ET7 | 3.6 | GB3 | 50 | 10 |
| Example 17 | 10 | C | 0.15 | HT2 | 40 | GB2 | 60 | 15 | CG1 | 2 | HT4 | 12.0 | ET1 | 28.8 | ET7 | 7.2 | GB3 | 50 | 10 |
| Example 18 | 10 | C | 0.3 | HT2 | 40 | GB2 | 60 | 15 | CG1 | 2 | HT4 | 12.0 | ET1 | 23.4 | ET7 | 12.6 | GB3 | 50 | 10 |
| Example 19 | 7 | A | 0.02 | HT1 | 50 | GB3 | 50 | 15 | CG1 | 1 | HT1 | 5.9 | ET4 | 47.8 | ET5 | 5.3 | GB3 | 40 | 15 |
| Example 20 | 7 | A | 0.15 | HT1 | 50 | GB3 | 50 | 15 | CG1 | 1 | HT1 | 5.9 | ET4 | 42.5 | ET5 | 10.6 | GB3 | 40 | 15 |
| Example 21 | 7 | A | 0.3 | HT1 | 50 | GB3 | 50 | 15 | CG1 | 1 | HT1 | 5.9 | ET4 | 34.5 | ET5 | 18.6 | GB3 | 40 | 15 |

*1 A: SOLBIN A (a vinyl chloride-vinyl acetate copolymer resin, manufactured by Nissin Chemical Industry Co., Ltd.)
B: SOLBIN C (a vinyl chloride-vinyl acetate copolymer resin, manufactured by Nissin Chemical Industry Co., Ltd.)
C: SOLBIN TA5R (a vinyl chloride-vinyl acetate copolymer resin, manufactured by Nissin Chemical Industry' Co., Ltd.)
D: CM8000 (a polyamide resin, manufactured by Toray Industries, Inc.)
E: MARUKA LYNCUR M (a polyvinylphenol resin, manufactured by Maruzen Petrochemical Co., Ltd.)
F: U-VAN 2020 (a melamine resin, manufactured by Mitsui Chemicals, Inc.)

TABLE 4

| | Anodic Oxide Coating Film | Interlayer Film | | Charge Transport Layer: Hole Transport Material | | Charge Transport Layer: Resin Binder | | Charge Transport Layer: Film | Charge Generation Layer: Charge Generation Material | | Charge Generation Layer: Hole Transport Material | | Charge Generation Layer: First Electron Transport Material | | Charge Generation Layer: Second Electron Transport Material | | Charge Generation Layer: Resin Binder | | Charge Generation Layer: Film |
|---|---|---|---|---|---|---|---|---|---|---|---|---|---|---|---|---|---|---|---|
| | Thickness (μm) | Material *1 | Thickness (μm) | Material | Content (%) | Material | Content (%) | Thickness (μm) | Material | Content (%) | Material | Content (%) | Material | Content (%) | Material | Content (%) | Material | Content (%) | Thickness (μm) |
| Example 22 | 7 | B | 0.02 | HT2 | 45 | GB3 | 55 | 20 | CG1 | 1.5 | HT2 | 6.9 | ET4 | 37.3 | ET5 | 4.2 | GB1 | 50 | 20 |
| Example 23 | 7 | B | 0.15 | HT2 | 45 | GB3 | 55 | 20 | CG1 | 1.5 | HT2 | 6.9 | ET4 | 33.3 | ET5 | 8.3 | GB1 | 50 | 20 |
| Example 24 | 7 | B | 0.3 | HT2 | 45 | GB3 | 55 | 20 | CG1 | 1.5 | HT2 | 6.9 | ET4 | 27.0 | ET5 | 14.5 | GB1 | 50 | 20 |
| Example 25 | 7 | C | 0.02 | HT4 | 40 | GB3 | 60 | 25 | CG1 | 2 | HT4 | 10.0 | ET4 | 27.0 | ET5 | 3.0 | GB2 | 60 | 25 |
| Example 26 | 7 | C | 0.15 | HT4 | 40 | GB3 | 60 | 25 | CG1 | 2 | HT4 | 10.0 | ET4 | 24.0 | ET5 | 6.0 | GB2 | 60 | 25 |
| Example 27 | 7 | C | 0.3 | HT4 | 40 | GB3 | 60 | 25 | CG1 | 2 | HT4 | 10.0 | ET4 | 19.5 | ET5 | 10.5 | GB2 | 60 | 25 |
| Comparative Example 1 | 7 | none | | HT1 | 50 | GB1 | 50 | 10 | CG1 | 1 | HT1 | 5.0 | ET1 | 35.2 | ET5 | 8.8 | GB1 | 50 | 15 |
| Comparative Example 2 | 7 | D | 0.15 | HT1 | 50 | GB1 | 50 | 10 | CG1 | 1 | HT1 | 5.0 | ET1 | 35.2 | ET5 | 8.8 | GB1 | 50 | 15 |
| Comparative Example 3 | 7 | D | 0.5 | HT1 | 50 | GB1 | 50 | 10 | CG1 | 1 | HT1 | 5.0 | ET1 | 35.2 | ET5 | 8.8 | GB1 | 50 | 15 |
| Comparative Example 4 | 7 | D | 1 | HT1 | 50 | GB1 | 50 | 10 | CG1 | 1 | HT1 | 5.0 | ET1 | 35.2 | ET5 | 8.8 | GB1 | 50 | 15 |
| Comparative Example 5 | 7 | E | 0.15 | HT1 | 50 | GB1 | 50 | 10 | CG1 | 1 | HT1 | 5.0 | ET1 | 35.2 | ET5 | 8.8 | GB1 | 50 | 15 |
| Comparative Example 6 | 7 | E | 0.5 | HT1 | 50 | GB1 | 50 | 10 | CG1 | 1 | HT1 | 5.0 | ET1 | 35.2 | ET5 | 8.8 | GE11 | 50 | 15 |
| Comparative Example 7 | 7 | E | 1 | HT1 | 50 | GB1 | 50 | 10 | CG1 | 1 | HT1 | 5.0 | ET1 | 35.2 | ET5 | 8.8 | GB1 | 50 | 15 |
| Comparative Example 8 | 7 | F | 0.15 | HT1 | 50 | GB1 | 50 | 10 | CG1 | 1 | HT1 | 5.0 | ET1 | 35.2 | ET5 | 8.8 | GB1 | 50 | 15 |
| Comparative Example 9 | 7 | F | 0.5 | HT1 | 50 | GB1 | 50 | 10 | CG1 | 1 | HT1 | 5.0 | ET1 | 35.2 | ET5 | 8.8 | GB1 | 50 | 15 |
| Comparative Example 10 | 7 | F | 1 | HT1 | 50 | GB1 | 50 | 10 | CG1 | 1 | HT1 | 5.0 | ET1 | 35.2 | ET5 | 8.8 | GB1 | 50 | 15 |
| Comparative Example 11 | 7 | A | 0.01 | HT2 | 45 | GB2 | 55 | 12.5 | CG1 | 1.5 | HT2 | 6.9 | ET4 | 37.3 | ET5 | 4.2 | GB1 | 50 | 12.5 |
| Comparative Example 12 | 7 | B | 0.01 | HT2 | 45 | GB2 | 55 | 12.5 | CG1 | 1.5 | HT2 | 6.9 | ET4 | 33.3 | ET5 | 8.3 | GB1 | 50 | 12.5 |
| Comparative Example 13 | 7 | C | 0.01 | HT2 | 45 | GB2 | 55 | 12.5 | CG1 | 1.5 | HT2 | 6.9 | ET4 | 27.0 | ET5 | 14.5 | GB1 | 50 | 12.5 |
| Comparative Example 14 | 7 | A | 0.5 | HT2 | 45 | GB2 | 55 | 12.5 | CG1 | 1.5 | HT2 | 6.9 | ET4 | 37.3 | ET5 | 4.2 | GB1 | 50 | 12.5 |
| Comparative Example 15 | 7 | B | 0.5 | HT2 | 45 | GB2 | 55 | 12.5 | CG1 | 1.5 | HT2 | 6.9 | ET4 | 33.3 | ET5 | 8.3 | GB1 | 50 | 12.5 |
| Comparative Example 16 | 7 | C | 0.5 | HT2 | 45 | GB2 | 55 | 12.5 | CG1 | 1.5 | HT2 | 6.9 | ET4 | 27.0 | ET5 | 14.5 | GB1 | 50 | 12.5 |

TABLE 5

| | Anodic Oxide Coating Film Thickness (μm) | Interlayer Film Material *1 | Interlayer Film Thickness (μm) | Charge Transport Layer: Hole Transport Material Material | Hole Transport Material Content (%) | Resin Binder Material | Resin Binder Content (%) | Charge Transport Layer Film Thickness (μm) | Charge Generation Layer: Charge Generation Material Material | Charge Generation Material Content (%) |
|---|---|---|---|---|---|---|---|---|---|---|
| Comparative Example 17 | 1 | A | 0.15 | HT1 | 50 | GB1 | 50 | 10 | CG1 | 1 |
| Comparative Example 18 | 1 | B | 0.15 | HT1 | 50 | GB1 | 50 | 10 | CG1 | 1 |
| Comparative Example 19 | 1 | C | 0.15 | HT1 | 50 | GB1 | 50 | 10 | CG1 | 1 |
| Comparative Example 20 | 12 | A | 0.15 | HT1 | 50 | GB1 | 50 | 10 | CG1 | 1 |
| Comparative Example 21 | 12 | B | 0.15 | HT1 | 50 | GB1 | 50 | 10 | CG1 | 1 |
| Comparative Example 22 | 12 | C | 0.15 | HT1 | 50 | GB1 | 50 | 10 | CG1 | 1 |
| Comparative Example 23 | none | A | 0.15 | HT1 | 50 | GB1 | 50 | 10 | CG1 | 1 |

| | Charge Generation Layer: Hole Transport Material Material | Hole Transport Material Content (%) | First Electron Transport Material Material | First Electron Transport Material Content (%) | Second Electron Transport Material Material | Second Electron Transport Material Content (%) | Resin Binder Material | Resin Binder Content (%) | Film Thickness (μm) |
|---|---|---|---|---|---|---|---|---|---|
| Comparative Example 17 | HT1 | 5.0 | ET1 | 35.2 | ET5 | 8.8 | GB1 | 50 | 15 |
| Comparative Example 18 | HT1 | 5.0 | ET1 | 35.2 | ET5 | 8.8 | GB1 | 50 | 15 |
| Comparative Example 19 | HT1 | 5.0 | ET1 | 35.2 | ET5 | 8.8 | GB1 | 50 | 15 |
| Comparative Example 20 | HT1 | 5.0 | ET1 | 35.2 | ET5 | 8.8 | GB1 | 50 | 15 |
| Comparative Example 21 | HT1 | 5.0 | ET1 | 35.2 | ET5 | 8.8 | GB1 | 50 | 15 |
| Comparative Example 22 | HT1 | 5.0 | ET1 | 35.2 | ET5 | 8.8 | GB1 | 50 | 15 |
| Comparative Example 23 | HT1 | 5.0 | ET1 | 35.2 | ET5 | 8.8 | GB1 | 50 | 15 |

TABLE 6

| | Evaluation Results: Ghost | Solid Black Density Non-uniformity | Black Spots (Color Spots) | Adhesion |
|---|---|---|---|---|
| Example 1 | ○ | ○ | ○ | ○ |
| Example 2 | ○ | ○ | ○ | ○ |
| Example 3 | ○ | ○ | ○ | ○ |
| Example 4 | ○ | ○ | ○ | ○ |
| Example 5 | ○ | ○ | ○ | ○ |
| Example 6 | ○ | ○ | ○ | ○ |
| Example 7 | ○ | ○ | ○ | ○ |
| Example 8 | ○ | ○ | ○ | ○ |
| Example 9 | ○ | ○ | ○ | ○ |
| Example 10 | ○ | ○ | ○ | ○ |
| Example 11 | ○ | ○ | ○ | ○ |
| Example 12 | ○ | ○ | ○ | ○ |
| Example 13 | ○ | ○ | ○ | ○ |
| Example 14 | ○ | ○ | ○ | ○ |
| Example 15 | ○ | ○ | ○ | ○ |
| Example 16 | ○ | ○ | ○ | ○ |
| Example 17 | ○ | ○ | ○ | ○ |
| Example 18 | ○ | ○ | ○ | ○ |
| Example 19 | ○ | ○ | ○ | ○ |
| Example 20 | ○ | ○ | ○ | ○ |
| Example 21 | ○ | ○ | ○ | ○ |

TABLE 7

| | Evaluation Results: Ghost | Solid Black Density Non-uniformity | Black Spots (Color Spots) | Adhesion |
|---|---|---|---|---|
| Example 22 | ○ | ○ | ○ | ○ |
| Example 23 | ○ | ○ | ○ | ○ |
| Example 24 | ○ | ○ | ○ | ○ |
| Example 25 | ○ | ○ | ○ | ○ |
| Example 26 | ○ | ○ | ○ | ○ |
| Example 27 | ○ | ○ | ○ | ○ |
| Comparative Example 1 | Δ | x | ○ | ○ |
| Comparative Example 2 | Δ | x | ○ | ○ |
| Comparative Example 3 | Δ | x | ○ | ○ |
| Comparative Example 4 | x | ○ | ○ | ○ |
| Comparative Example 5 | Δ | x | ○ | Δ |
| Comparative Example 6 | x | x | ○ | Δ |
| Comparative Example 7 | x | x | ○ | x |
| Comparative Example 8 | Δ | x | ○ | Δ |

TABLE 7-continued

| | Evaluation Results | | | |
|---|---|---|---|---|
| | Ghost | Solid Black Density Non-uniformity | Black Spots (Color Spots) | Adhesion |
| Comparative Example 9 | x | x | ○ | Δ |
| Comparative Example 10 | x | ○ | ○ | x |
| Comparative Example 11 | ○ | ○ | ○ | Δ |
| Comparative Example 12 | ○ | ○ | ○ | Δ |
| Comparative Example 13 | ○ | ○ | ○ | Δ |
| Comparative Example 14 | Δ | Δ | ○ | ○ |
| Comparative Example 15 | Δ | Δ | ○ | ○ |
| Comparative Example 16 | Δ | Δ | ○ | ○ |

TABLE 8

| | Evaluation Results | | | |
|---|---|---|---|---|
| | Ghost | Solid Black Density Non-uniformity | Black Spots (Color Spots) | Adhesion |
| Comparative Example 17 | ○ | ○ | Δ | ○ |
| Comparative Example 18 | ○ | ○ | Δ | ○ |
| Comparative Example 19 | ○ | ○ | Δ | ○ |
| Comparative Example 20 | ○ | ○ | Δ | ○ |
| Comparative Example 21 | ○ | ○ | Δ | ○ |
| Comparative Example 22 | ○ | ○ | Δ | ○ |
| Comparative Example 23 | ○ | Δ | x | ○ |

The photoconductors in Examples had an electroconductive base member, an anodic oxide coating provided on the electroconductive base member, and further a predetermined interlayer provided on the anodic oxide coating, but a combination different from this was used in Comparative Examples. The Tables have revealed that, in Examples, the photoconductors in both devices: a black and white high-speed printer HL-L5200DW and a tandem color printer HL-L3230CDW have been found to generate no ghost image, no solid black density nonuniformity, or no black spot, afford favorable image quality, and have excellent adhesion in the same manner between both devices, differently from the photoconductors in Comparative Examples.

In contrast, Comparative Example 1 having only an anodic oxide coating and no interlayer exhibited large solid black density nonuniformity and a worsened ghost image. In Comparative Examples 2 to 4 in which a polyamide resin was used as an interlayer resin material in place of a vinyl chloride-vinyl acetate copolymer resin, the larger film thickness improved the solid black density nonuniformity, but did not make it possible to suppress generation of ghost images, and the generation of ghost images tended to be further worsened by a larger film thickness. Furthermore, in Comparative Examples 5 to 7 in which a polyvinylphenol resin was used as an interlayer resin material in place of a vinyl chloride-vinyl acetate copolymer resin, the larger film thickness did not improve the solid black density nonuniformity, ghost images were generated regardless of the film thickness, and the adhesion was insufficient. Furthermore, in Comparative Examples 8 to 10 in which a melamine resin was used as an interlayer resin material in place of a vinyl chloride-vinyl acetate copolymer resin, the larger film thickness improved the solid black density nonuniformity, but did not make it possible to suppress generation of ghost images, and the generation of ghost images tended to be further worsened by a larger film thickness, and the adhesion was insufficient. Furthermore, in Comparative Example 11 to 13 in which the interlayer had too small a film thickness, the adhesion was worsened. Furthermore, in Comparative Examples 14 to 16 in which the interlayer had too large a film thickness, both the solid black density nonuniformity and ghost images were worsened. In Comparative Examples 17 to 19 in which the anodic oxide coating was too thin and in Comparative Examples 20 to 22 in which the anodic oxide coating was too thick, the pressure resistance was insufficient, and black spots (color spots) were generated during repetitive printing under a high temperature and high humidity environment. In Comparative Example 23 in which no anodic oxide coating was provided, leakage was caused, and many black spots (color spots) were found in the solid white image during repetitive printing under a high temperature and high humidity environment.

DESCRIPTION OF SYMBOLS

1 Electroconductive Base Member
2 Anodic Oxide Coating
3 Interlayer
4 Photosensitive Layer
4-1 Charge Transport Layer
4-2 Charge Generation Layer
5 Surface Protection Layer
10 Photoconductor for Electrophotography
11 Charging Member
12 High Voltage Power Supply
13 Image Exposure Member
14 Development Member
15 Transfer Member
16 Cleaning Member
17 Transfer Belt
18 Substrate
21 Charging Member
22 Image Exposure Member
23 Development Position Probe
24 Transfer Member
25 Potential-after-transfer Probe
60, 70 Electrophotographic Device

The invention claimed is:

1. A photoconductor for electrophotography, comprising:
an electroconductive base member;
an anodic oxide coating provided on the electroconductive base member and having a film thickness of 2 μm or more and 10 μm or less;
an interlayer provided on the anodic oxide coating and containing a vinyl chloride-vinyl acetate copolymer resin, and having a film thickness of 0.02 μm or more and 0.3 μm or less; and
a photosensitive layer including:
a charge transport layer formed on the interlayer and containing a charge transport material and a first resin binder, and a charge generation layer laminated on the charge transport layer and containing a charge generation material, a hole transport material, an electron transport material, and a second resin binder, wherein the electron transport material comprises:

a first electron transport material that is a naphthalenetetracarboxylic diimide compound; and a second electron transport material that is an azoquinone compound, a diphenoquinone compound, or a stilbenequinone compound and that has a mobility of $17\times10^{-8}$ $cm^2/V\cdot s$ or more.

2. The photoconductor for electrophotography according to claim 1, wherein each of the charge transport layer and the charge generation layer has a film thickness of 5 μm or more and 25 μm or less, and the photosensitive layer has a total film thickness of 15 μm or more and 50 μm or less.

3. The photoconductor for electrophotography according to claim 2, wherein the hole transport material has an ionization potential of 5.4 eV or less.

4. The photoconductor for electrophotography according to claim 2, wherein the hole transport material has a mobility of $2\times10^{-5}$ $cm^2/V\cdot s$ or more.

5. The photoconductor for electrophotography according to claim 1, wherein the charge generation material is titanylphthalocyanine.

6. The photoconductor for electrophotography according to claim 1, wherein the hole transport material has an ionization potential of 5.4 eV or less.

7. The photoconductor for electrophotography according to claim 1, wherein the hole transport material has a mobility of $2\times10^{-5}$ $cm^2/V\cdot s$ or more.

8. The photoconductor for electrophotography according to claim 1, wherein the electroconductive base member is an aluminum-made electroconductive base member.

9. A method of producing a photoconductor for electrophotography according to claim 1, comprising:

providing the electroconductive base member;

forming the anodic oxide coating on the electroconductive base member and having the film thickness of 2 μm or more and 10 μm or less;

forming the interlayer on the anodic oxide coating containing the vinyl chloride-vinyl acetate copolymer resin and having the film thickness of 0.02 μm or more and 0.3 μm or less; and forming the photosensitive layer on the interlayer, including forming the charge transport layer on the interlayer, and forming the charge generation layer on the charge transport layer, using a dip coating method, wherein:

the charge transport layer contains the charge transport material and the first resin binder, the charge generation layer contains the charge generation material, the hole transport material, the first electron transport material that is the naphthalenetetracarboxylic diimide compound, the second electron transport material that is the azoquinone compound, a diphenoquinone compound, or a stilbenequinone compound and that has a mobility of $17\times10^{-8}$ $cm^2/V\cdot s$ or more, and the second resin binder.

10. The method according to claim 9, wherein the electroconductive base member is comprised of aluminum.

* * * * *